US007729647B2

(12) United States Patent
Koike et al.

(10) Patent No.: US 7,729,647 B2
(45) **Date of Patent: *Jun. 1, 2010**

(54) IMAGE FORMING APPARATUS, IMAGE FORMING METHOD, AND IMAGE FORMING SYSTEM

(75) Inventors: Naoki Koike, Suwa (JP); Hiroshi Kato, Suwa (JP); Shinichi Kamoshida, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 503 days.

This patent is subject to a terminal disclaimer.

(21) Appl. No.: 11/678,449

(22) Filed: Feb. 23, 2007

(65) Prior Publication Data

US 2007/0212088 A1 Sep. 13, 2007

(30) Foreign Application Priority Data

Mar. 2, 2006 (JP) ..... 2006-056830
Nov. 1, 2006 (JP) ..... 2006-297693

(51) Int. Cl.
*G03G 15/08* (2006.01)

(52) U.S. Cl. ..... 399/285; 399/286

(58) Field of Classification Search ..... 399/53, 399/55, 235, 240, 270, 276, 279, 284–286
See application file for complete search history.

(56) References Cited

U.S. PATENT DOCUMENTS 5,311,263 A * 5/1994 Suzuki et al. ..... 399/276
5,451,713 A * 9/1995 Suzuki et al. ..... 399/285
6,889,024 B2 * 5/2005 Shiraki et al.
2007/0110484 A1 * 5/2007 Yamada et al. ..... 399/286

FOREIGN PATENT DOCUMENTS

| | | |
|---|---|---|
| JP | 04-145472 | 5/1992 |
| JP | 04-240671 | 8/1992 |
| JP | 05-142950 | 6/1993 |
| JP | 06-083150 | 3/1994 |
| JP | 07-077867 | 3/1995 |
| JP | 2000-098708 | 4/2000 |
| JP | 2003-208012 | 7/2003 |
| JP | 2004-219640 | 8/2004 |

OTHER PUBLICATIONS

English Translation of JP06-083150A.*
English Translation of JP2000-098708A.*

* cited by examiner

*Primary Examiner*—David P Porta
*Assistant Examiner*—Milton Gonzalez
(74) *Attorney, Agent, or Firm*—Hogan & Hartson LLP

(57) ABSTRACT

An image forming apparatus includes a developer bearing member for transporting developer to an opposing position opposing an image bearing member. Regularly-disposed concave sections are formed on a surface of the developer bearing member. An alternating voltage that includes a first voltage for moving developer from the developer bearing member toward the image bearing member and a second voltage for moving developer from the image bearing member toward the developer bearing member is applied to the developer bearing member. A cycle period of the alternating voltage is smaller than or equal to a minimum width of the concave section in a circumferential direction of the developer bearing member divided by a moving velocity of a surface of the rotating developer bearing member.

13 Claims, 20 Drawing Sheets

| TYPE OF MEDIUM | V | T1 | T2 |
|---|---|---|---|
| PLAIN PAPER | 300mm/s | 0.3ms | 1.0ms |
| THICK PAPER | 225mm/s | 0.4ms | 1.1ms |
| OHP TRANSPARENCY | 150mm/s | 0.5ms | 1.2ms |

FIG. 18

IMAGE FORMING APPARATUS, IMAGE FORMING METHOD, AND IMAGE FORMING SYSTEM

CROSS-REFERENCE TO RELATED APPLICATIONS

The present application claims priority upon Japanese Patent Application No. 2006-56830 filed on Mar. 2, 2006, and Japanese Patent Application No. 2006-297693 filed on Nov. 1, 2006, which are herein incorporated by reference.

BACKGROUND

1. Technical Field

The present invention relates to image forming apparatuses, image forming methods and image forming systems.

2. Related Art

Image forming apparatuses such as laser beam printers are already well known. Such image forming apparatuses include, for example, an image bearing member for bearing latent images, and a developer bearing member that rotates while bearing developer to transport the developer to a position opposing the image bearing member. When image signals or the like are transmitted from an external apparatus such as a host computer, latent images borne on the image bearing member are developed using the developer that has been transported to the opposing position by the developer bearing member, thereby forming developer images. Then, the developer images are transferred onto a medium so as to ultimately form images on the medium.

During development of the latent images using developer, some of such image forming apparatuses apply to the developer bearing member an alternating voltage that includes a first voltage for shifting developer from the developer bearing member to the image bearing member, and a second voltage for shifting developer from the image bearing member to the developer bearing member.

Regularly disposed concave sections are sometimes provided on the surface of the above-described developer bearing member such that a sufficient amount of developer is borne on the surface of the developer bearing member (in other words, in order to ensure a sufficiently large surface area for the surface on which developer is borne), or for other reasons.

However, developer tends to be stuck in the concave section, where the rollability of developer tends to become unfavorable. In addition, in image forming apparatuses that includes a charging member for charging developer borne on the developer bearing member by contacting the developer bearing member, the force of the charging member pressing against developer is weaker at the concave sections (compared with convex sections), which may invite inappropriate frictional charging.

For this reason, a developer at the concave sections tends to suffer insufficient charging. As a result, such a developer causes so-called fog.

It should be noted that JP-A-5-142950 and JP-A-2004-219640 are examples of related technology.

SUMMARY

The present invention was arrived at in light of the above-described problems, and it is an object thereof to appropriately prevent occurrence of fog.

A primary aspect of the invention is an image forming apparatus as follows.

An image forming apparatus including:

an image bearing member for bearing a latent image, a developer bearing member for transporting developer to an opposing position opposing the image bearing member by rotating with developer being borne thereon, the developer bearing member having regularly-disposed concave sections formed on a surface thereof, and an alternating voltage applying section for applying to the developer bearing member an alternating voltage that includes a first voltage for moving developer from the developer bearing member toward the image bearing member and a second voltage for moving developer from the image bearing member toward the developer bearing member in order to develop the latent image using the developer that has been transported to the opposing position, wherein a cycle period of the alternating voltage is smaller than or equal to a value obtained by dividing a minimum width of the concave section in a circumferential direction of the developer bearing member by a moving velocity of a surface of the developer bearing member during rotation of the developer bearing member.

Other features of the invention will become clear through the accompanying drawings and the following description.

BRIEF DESCRIPTION OF THE DRAWINGS

For a more complete understanding of the present invention and the advantages thereof, reference is now made to the following description taken in conjunction with the accompanying drawings.

FIG. 18 is a table showing the relationship between the type of media and a moving velocity V of the developing roller 510 and the like.

DESCRIPTION OF EXEMPLARY EMBODIMENTS

Figure 1:
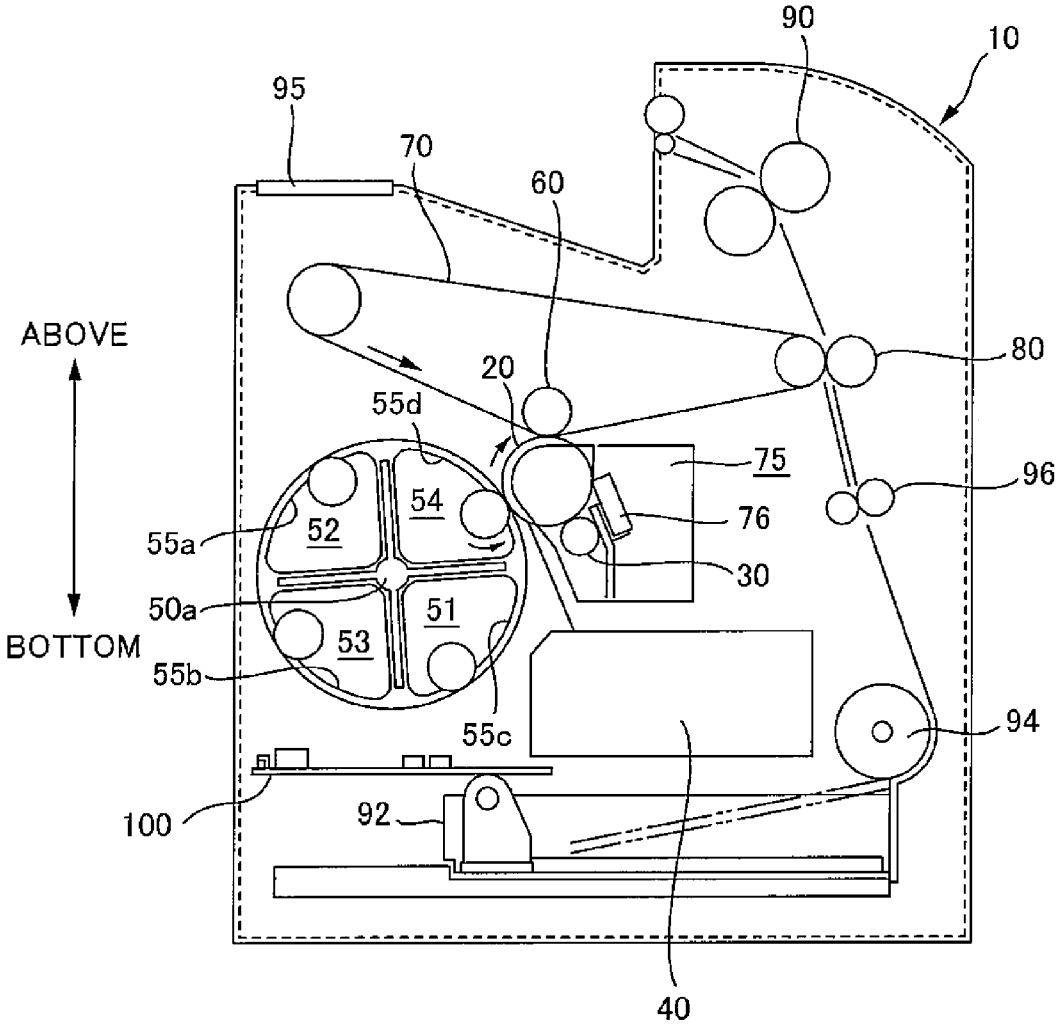
FIG. 1 is a diagram showing the main structural components constituting a printer 10.

At least the following matters will be made clear by the explanation in the present specification and the description of the accompanying drawings.

An image forming apparatus including:

an image bearing member for bearing a latent image, a developer bearing member for transporting developer to an opposing position opposing the image bearing member by rotating with developer being borne thereon, the developer bearing member having regularly-disposed concave sections formed on a surface thereof, and an alternating voltage applying section for applying to the developer bearing member an alternating voltage that includes a first voltage for moving developer from the developer bearing member toward the image bearing member and a second voltage for moving developer from the image bearing member toward the developer bearing member in order to develop the latent image using the developer that has been transported to the opposing position, wherein a cycle period of the alternating voltage is smaller than or equal to a value obtained by dividing a minimum width of the concave section in a circumferential direction of the developer bearing member by a moving velocity of a surface of the developer bearing member during rotation of the developer bearing member.

With such an image forming apparatus, it is possible to appropriately prevent occurrence of fog.

In such an image forming apparatus, the concave section may be composed of two kinds of helical groove sections that have different inclination angles with respect to the circumferential direction, and the two kinds of helical groove sections mutually intersect so as to form a grid pattern.

In such an image forming apparatus, the developer bearing member may include a rhomboid-shaped top surface surrounded by the two kinds of helical groove sections, and one of two diagonal lines of the rhomboid-shaped top surface is along the circumferential direction.

In such an image forming apparatus, the developer bearing member may include a square-shaped top surface surrounded by the two kinds of helical groove sections.

In such an image forming apparatus, the voltage that the alternating voltage applying section applies to the developer bearing member may be only the first voltage and the second voltage, and the alternating voltage applying section may alternately apply the first voltage and the second voltage.

In such an image forming apparatus, the image bearing member may be rotatable, and the moving velocity of the surface of the developer bearing member during rotation of the developer bearing member may be different from a moving velocity of a surface of the image bearing member during rotation of the image bearing member.

In such a case, the developer drawn back to the developer bearing member side has good chargeability.

In such an image forming apparatus, wherein the moving velocity may be variable, and when the moving velocity is changed, the cycle period of the alternating voltage may be changed so that the cycle period of the alternating voltage may be smaller than or equal to a value obtained by dividing the minimum width by the moving velocity.

In such a case, regardless of the operational mode of the image forming apparatus, the above-described effect, that is, appropriate prevention of occurrence of fog, is achieved.

Such an image forming apparatus may further include a charging member opposing the image bearing member, which is for charging the image bearing member, and a superimposed voltage applying section for applying to the charging member a superimposed voltage in which a DC voltage and an AC voltage are superimposed, wherein the cycle period of the alternating voltage may be different from both of a value obtained by multiplying a cycle period of the superimposed voltage by any positive integer, and a value obtained by dividing the cycle period by any positive integer.

In such a case, in addition to appropriate prevention of occurrence of fog, since the cycle of the alternating voltage is different from both of a value obtained by multiplying the cycle of the superimposed voltage by any positive integer, and a value obtained by dividing the cycle by any positive integer, it is possible to prevent occurrence positions of two types of density unevenness from coinciding in succession. Therefore, conspicuous density unevenness in images can be prevented.

In such an image forming apparatus, the charging member may be a rotatable charging roller, and the charging roller opposes the image bearing member with a gap therebetween.

In such a case, the effect of suppressing conspicuous density unevenness in images can be achieved more effectively.

In such an image forming apparatus, the image bearing member may be rotatable, the alternating voltage applying section may alternately apply the first voltage and the second voltage for a predetermined period, when a portion of the image bearing member that is positioned at a charging position for charging with the charging member when the superimposed voltage applying section starts applying the superimposed voltage, reaches a developing position for developing using the developer transported to the opposing position through rotation of the image bearing member, the alternating voltage applying section may start applying one of the first voltage and the second voltage to the developer bearing member.

In such a case, the effect of suppressing conspicuous density unevenness in images can be achieved more effectively.

In such an image forming apparatus, the concave section may be composed of two kinds of helical groove sections that have different inclination angles with respect to the circumferential direction, and the two kinds of helical groove sections may mutually intersect so as to form a grid pattern, the developer bearing member may include a square-shaped top surface surrounded by the two kinds of helical groove sections, and one of two diagonal lines of the square-shaped top surface may be along the circumferential direction.

An image forming method including:

changing a moving velocity of a surface of a developer bearing member during rotation thereof, the developer bearing member being for transporting developer to an opposing position opposing an image bearing member by rotating with developer being borne thereon, and including regularly-disposed concave sections formed on the surface thereof, changing a cycle period of an alternating voltage that includes a first voltage for moving developer from the developer bearing member toward the image bearing member and a second voltage for moving developer from the image bearing member toward the developer bearing member so that the cycle period of the alternating voltage is smaller than or equal to a value obtained by dividing a minimum width of the concave section in a circumferential direction of the developer bearing member by the moving velocity after change, and changing a cycle period of a superimposed voltage in which a DC voltage and an AC voltage are superimposed, such that the cycle period after change of the alternating voltage are different from both of a value obtained by multiplying the changed cycle period of the superimposed voltage by any positive integer, and a value obtained by dividing the changed cycle period by any positive integer, charging the image bearing member by applying the superimposed voltage, whose cycle period has been changed, to a charging member opposing the image bearing member, and developing a latent image borne on the image bearing member using the developer that has been transported to the opposing position by applying the alternating voltage, whose cycle period has been changed, to the developer bearing member.

With such an image forming method, even if the moving velocity of the developer bearing member is changed, it is possible to appropriately prevent occurrence of fog and suppress conspicuous density unevenness in images.

In such a method, types of media on which an image can be formed may be plain paper and thick paper, and when an image is formed on the plain paper, the moving velocity of the surface of the developer bearing member may be increased, and when an image is formed on the thick paper, the moving velocity of the surface of the developer bearing member may be decreased.

In such a case, even if the type of the medium is changed, it is possible to appropriately prevent occurrence of fog and suppress conspicuous density unevenness in images.

An image forming system including:

a computer, and an image forming apparatus that can be connected to the computer, including an image bearing member for bearing a latent image, a developer bearing member for transporting developer to an opposing position opposing the image bearing member by rotating with developer being borne thereon, the developer bearing member having regularly-disposed concave sections formed on a surface thereof, and an alternating voltage applying section for applying to the developer bearing member an alternating voltage that includes a first voltage for moving developer from the developer bearing member toward the image bearing member and a second voltage for moving developer from the image bearing member toward the developer bearing member in order to develop the latent image using the developer that has been transported to the opposing position, a cycle period of the alternating voltage being smaller than or equal to a value obtained by dividing a minimum width of the concave section in a circumferential direction of the developer bearing member by a moving velocity of a surface of the developer bearing member during rotation of the developer bearing member.

With such an image forming system, it is possible to appropriately prevent occurrence of fog.

Overall Configuration Example of the Image Forming Apparatus

Next, using FIG. 1, an outline of a laser beam printer (hereinafter, also referred to as "printer") 10 serving as an example of an image forming apparatus is described. FIG. 1 is a diagram showing the main structural components constituting the printer 10. It should be noted that in FIG. 1, the vertical direction is indicated by the arrows, and, for example, a paper supply tray 92 is arranged at a lower section of the printer 10 and a fixing unit 90 is arranged at an upper section of the printer 10.

As shown in FIG. 1, the printer 10 according to this embodiment includes a charging unit 30, an exposing unit 40, a YMCK developing unit 50, a primary image transfer unit 60, an intermediate image transfer member 70, and a cleaning unit 75. These units are arranged in the direction of rotation of a photoconductor 20, which serves as an example of an image-bearing member for bearing latent images. The printer 10 further includes a secondary image transfer unit 80, a fixing unit 90, a display unit 95 constituted by a liquid-crystal panel and serving as means for displaying notifications to the user, and a control unit 100 for controlling these units and the like and managing the operations of the printer.

The photoconductor 20 has a hollow cylindrical conductive base and a photoconductive layer formed on the outer peripheral surface of the conductive base, and is rotatable about its center axis. In this embodiment, the photoconductor 20 rotates clockwise, as shown by the arrow in FIG. 1.

The charging unit 30 is a device for charging the photoconductor 20. The charging unit 30 is described in detail later. The exposing unit 40 is a device for forming a latent image on the charged photoconductor 20 by irradiating a laser beam thereon. The exposing unit 40 includes, for example, a semiconductor laser, a polygon mirror, and an F-θ lens, and irradiates a modulated laser beam onto the charged photoconductor 20, in accordance with image signals that have been input from a host computer (not shown in the drawings) such as a personal computer or a word processor.

The YMCK developing unit 50 is a device for developing the latent image formed on the photoconductor 20 using a toner, which is an example of developer contained in developing devices, that is, a black (K) toner contained in a black developing device 51, a magenta (M) toner contained in a magenta developing device 52, a cyan (C) toner contained in a cyan developing device 53, and a yellow (Y) toner contained in a yellow developing device 54.

By rotating the YMCK developing unit 50 in a state in which the four developing devices 51, 52, 53, and 54 are mounted, it is possible to move the positions of these four developing devices 51, 52, 53, and 54. More specifically, the YMCK developing unit 50 holds the four developing devices 51, 52, 53, and 54 with four holding sections 55*a*, 55*b*, 55*c*, and 55*d*. The four developing devices 51, 52, 53, and 54 can be rotated around a center shaft 50*a*, while maintaining their relative positions. Every time the image formation corresponding to one page is finished, a different one of the developing devices is caused to selectively oppose the photoconductor 20, thereby successively developing the latent image formed on the photoconductor 20 with the toners contained in each of the developing devices 51, 52, 53, and 54. It should be noted that each of the four developing devices 51, 52, 53, and 54 can be attached to and detached from the holding sections of the YMCK developing unit 50. Furthermore, details of the developing devices are described in detail further below.

The primary image transfer unit 60 is a device for transferring a single color toner image formed on the photoconductor 20 to the intermediate image transfer member 70. When the toners of four colors are successively transferred in a superimposed manner, a full-color toner image is formed on the intermediate image transfer member 70. The intermediate image transfer member 70 is an endless belt made by providing a tin vapor deposition layer on the surface of a PET film, and forming and laminating a semiconductive coating on its surface. The intermediate image transfer member 70 is driven to rotate at substantially the same circumferential speed as the photoconductor 20.

The secondary image transfer unit 80 is a device for transferring the single-color toner image or the full-color toner image formed on the intermediate image transfer member 70 onto a medium such as paper, film, or cloth. The fixing unit 90 is a device for fusing the single-color toner image or the full-color toner image, which has been transferred to the medium, onto the medium to turn it into a permanent image.

The cleaning unit 75 is a device that is provided between the primary image transfer unit 60 and the charging unit 30, has a rubber cleaning blade 76 contacting against the surface of the photoconductor 20, and is for removing the toner remaining on the photoconductor 20 by scraping it off with the cleaning blade 76 after the toner image has been transferred onto the intermediate image transfer member 70 by the primary image transfer unit 60.

Figure 2:
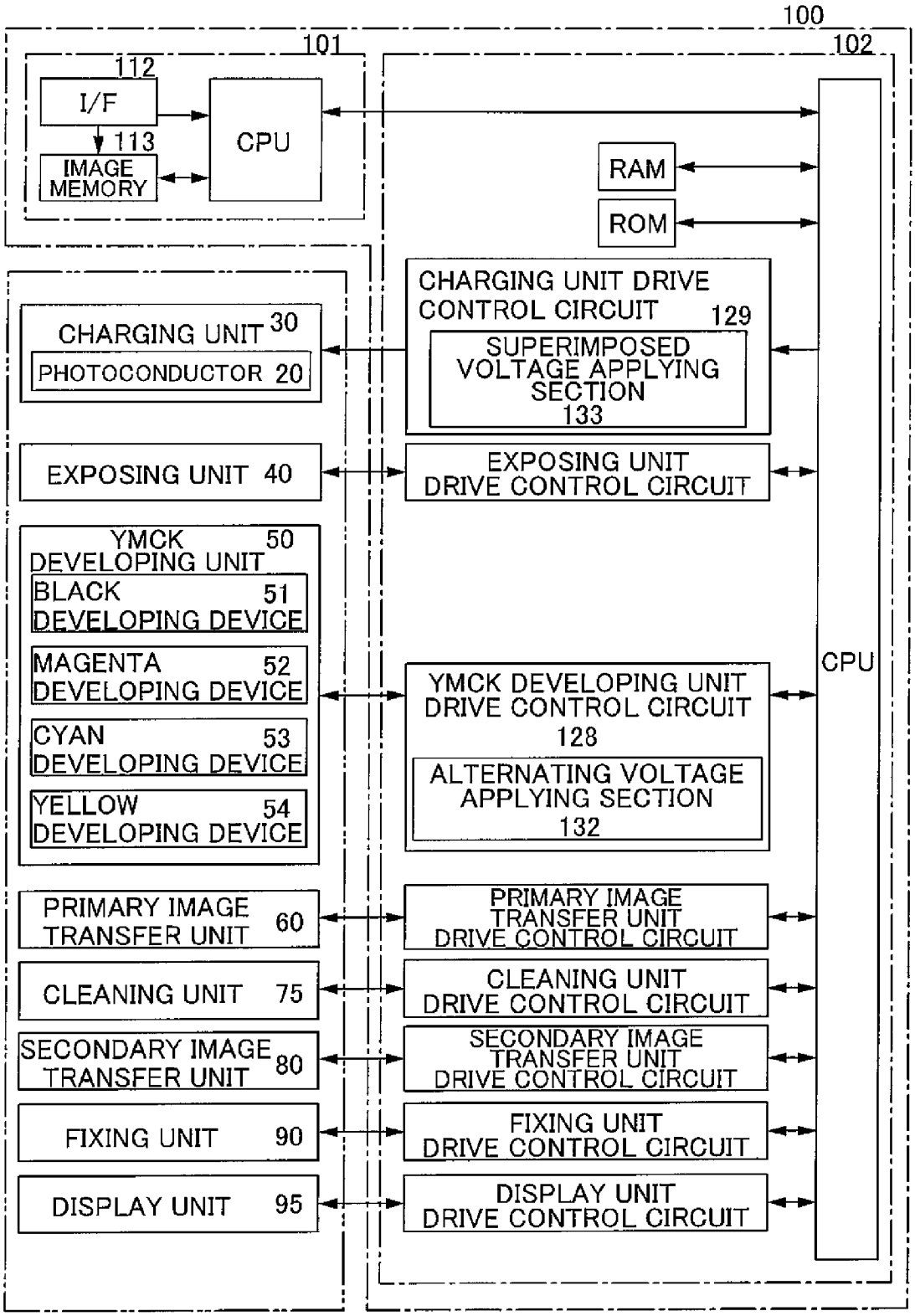
FIG. 2 is a block diagram showing a control unit of the printer 10 in FIG. 1.

The control unit 100 includes a main controller 101 and a unit controller 102, as shown in FIG. 2. An image signal and a control signal are input into the main controller 101, and in accordance with a command based on the image signal and the control signal, the unit controller 102 controls each of the units and the like to form the image.

Next, the operation of the printer 10 configured as above is described.

First, when an image signal and a control signal from a host computer (not shown in the drawings) are input to the main controller 101 of the printer 10 via an interface (I/F) 112, the photoconductor 20 and the intermediate image transfer body 70 are rotated under the control of the unit controller 102 in accordance with a command from the main controller 101. While rotating, the photoconductor 20 is successively charged by the charging unit 30 at a charging position.

The region of the photoconductor 20 that has been charged is brought to an exposure position through rotation of the photoconductor 20, and a latent image corresponding to image information of a first color, for example yellow Y, is formed in that region with the exposing unit 40. Also, the YMCK developing unit 50 positions the yellow developing device 54, which contains yellow (Y) toner, at the developing position opposing the photoconductor 20. The latent image formed on the photoconductor 20 is brought to the developing position through the rotation of the photoconductor 20, and is developed with yellow toner with the yellow developing device 54. Thus, a yellow toner image is formed on the photoconductor 20. The yellow toner image that is formed on the photoconductor 20 is brought to the primary image transfer position through rotation of the photoconductor 20 and is transferred to the intermediate image transfer member 70 with the primary image transfer unit 60. At this time, a primary image transfer voltage, which has an opposite polarity to the polarity to which the toner T is charged (negative polarity in the present embodiment), is applied to the primary image transfer unit 60. It should be noted that, during this process, the photoconductor 20 and the intermediate image transfer member 70 are in contact, whereas the secondary image transfer unit 80 is kept separated from the intermediate image transfer member 70.

By sequentially executing the above-described processes with each of the developing devices for the second color, the third color, and the fourth color, toner images in four colors corresponding to the respective image signals are transferred to the intermediate image transfer member 70 in a superimposed manner. Thus, a full color toner image is formed on the intermediate image transfer member 70.

With the rotation of the intermediate image transfer member 70, the full-color toner image formed on the intermediate image transfer member 70 reaches a secondary image transfer position, and is transferred onto the medium by the secondary image transfer unit 80. It should be noted that the medium is carried from the paper supply tray 92 to the secondary image transfer unit 80 via the paper supply roller 94 and the registration rollers 96. Also, when performing the image transfer operation, the secondary image transfer unit 80 is pressed against the intermediate image transfer member 70 while applying a secondary image transfer voltage to it.

The full-color toner image transferred onto the medium is heated and pressurized by the fixing unit 90 and thus fused to the medium.

On the other hand, after the photoconductor 20 has passed the primary image transfer position, the toner T adhering to the surface of the photoconductor 20 is scraped off with the cleaning blade 76 that is supported by the cleaning unit 75, and the photoconductor 20 is prepared to be charged in order to form the next latent image. The scraped-off toner T is collected in a remaining-toner collecting section of the cleaning unit 75.

Overview of the Control Unit

The configuration of the control unit 100 is described next, with reference to FIG. 2. The main controller 101 of the control unit 100 is electrically connected to the host computer via an interface 112, and is provided with an image memory 113 for storing image signals input into it from the host computer. The unit controller 102 is electrically connected to each of the units of the apparatus body (i.e., the charging unit 30, the exposing unit 40, the YMCK developing unit 50, the primary image transfer unit 60, the cleaning unit 75, the secondary image transfer unit 80, the fixing unit 90, and the display unit 95), detects the state of each of the units by receiving signals from sensors provided in those units, and controls each of the units in accordance with the signals that are input from the main controller 101.

It should be noted that a YMCK developing unit drive control circuit 128 that is connected to the YMCK developing unit 50 is provided with an alternating voltage applying section 132 (also simply referred to as the "voltage applying section"). The alternating voltage applying section 132 applies an alternating voltage (hereinafter, also referred to as the "developing bias") to a developing roller 510 so as to form an alternating electric field between the developing roller 510 and the photoconductor 20, for developing the latent images using toners (details are described later). A charging unit drive control circuit 129 that is connected to the charging unit 30 is provided with a superimposed voltage applying section 133. The superimposed voltage applying section 133 applies a superimposed voltage (hereinafter, also referred to as the "charging bias") to a charging roller 31 so as to form an alternating electric field between the charging roller 31 and the photoconductor 20, for charging the photoconductor 20.

Regarding the Charging Unit 30

Figure 3A:
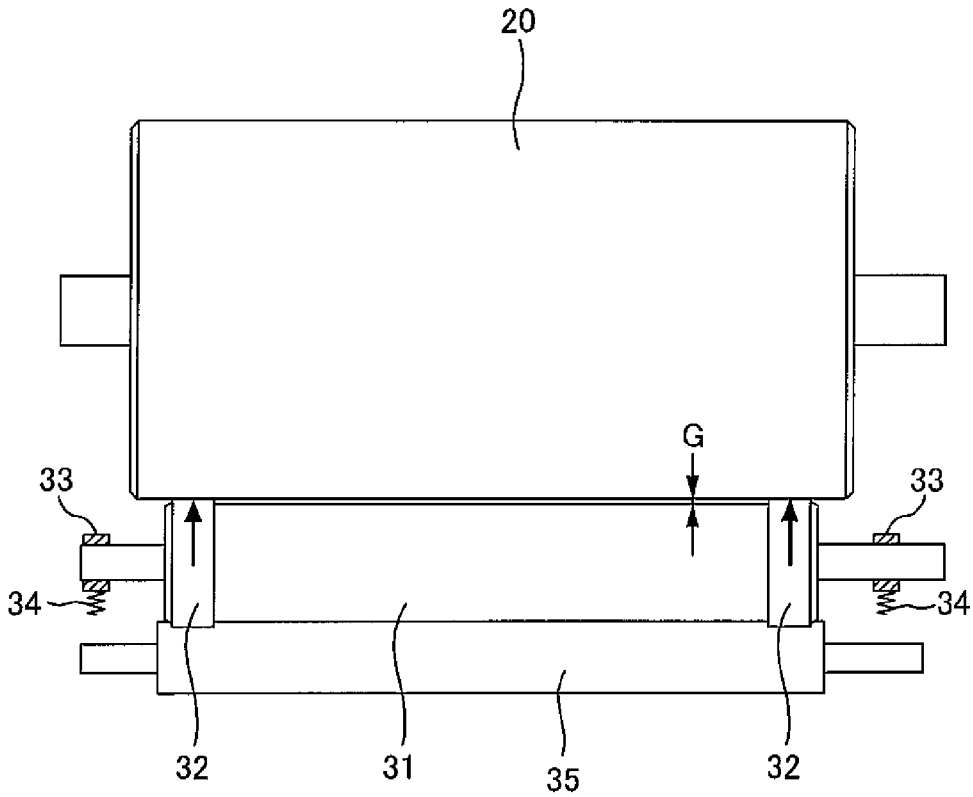
FIG. 3A is a schematic view showing a photoconductor and a charging unit 30.
Figure 3B:
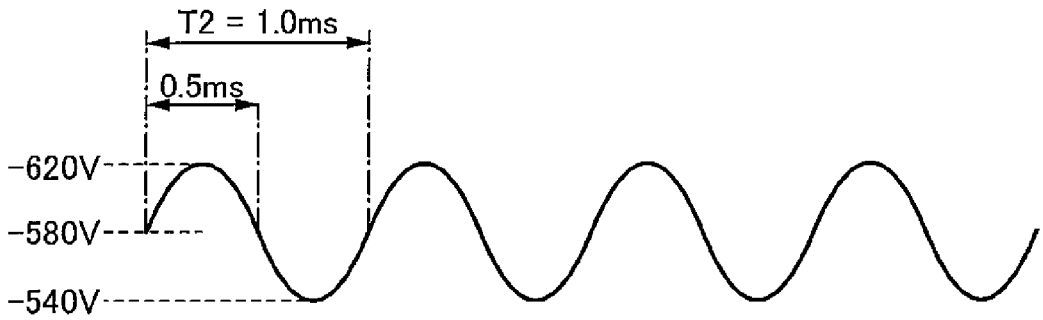
FIG. 3B is a schematic view showing a charging bias that is to be applied to a charging roller 31.

Next, the charging unit 30, which charges the photoconductor 20, is described with reference to FIGS. 3A and 3B. FIG. 3A is a schematic view showing the photoconductor 20 and the charging unit 30. FIG. 3B is a schematic view showing a superimposed voltage applied to the charging roller 31.

The charging unit 30 includes the charging roller 31 that opposes the photoconductor 20 with a gap present therebetween, and that can rotate and serves as an example of a charging member for charging the photoconductor 20, and a cleaning roller 35 (not shown in FIG. 1) for cleaning the surface of the charging roller 31 by contacting against the charging roller 31. The charging roller 31 is configured by a metal shaft with conductive coating being provided on the surface thereof. In addition, a tape 32 that contacts against the photoconductor 20 is attached to the charging roller 31 at both end portions in the axial direction thereof. Since the outside diameter of the tape 32 is larger than the outside diameter of the center portion of the charging roller 31, a gap G is formed between the center portion and the photoconductor 20. Therefore, the charging roller 31 charges the photoconductor 20 in a non-contacting manner.

Also, the charging unit 30 includes a bearing 33 that rotatably supports the charging roller 31, and a spring 34 that biases the charging roller 31 toward the photoconductor 20 via the bearing 33. As a result of the charging roller 31 being biased toward the photoconductor 20 with the biasing force of the spring 34, the tape 32 contacts against the photoconductor 20.

Here, charging of the photoconductor 20 is described with reference to FIG. 3B. When charging the photoconductor 20, the superimposed voltage applying section 133 applies to the charging roller 31*a* superimposed voltage (charging bias) in which DC voltage and AC voltage are superimposed. Specifically, (AC voltage component) voltage with an amplitude range between −620 V and −540 V centering on −580 V is applied to the charging roller 31. Further, the cycle period of the charging bias (this cycle period is referred to as "T2") is 0.9 ms.

Regarding the Developing Device

Figure 4:
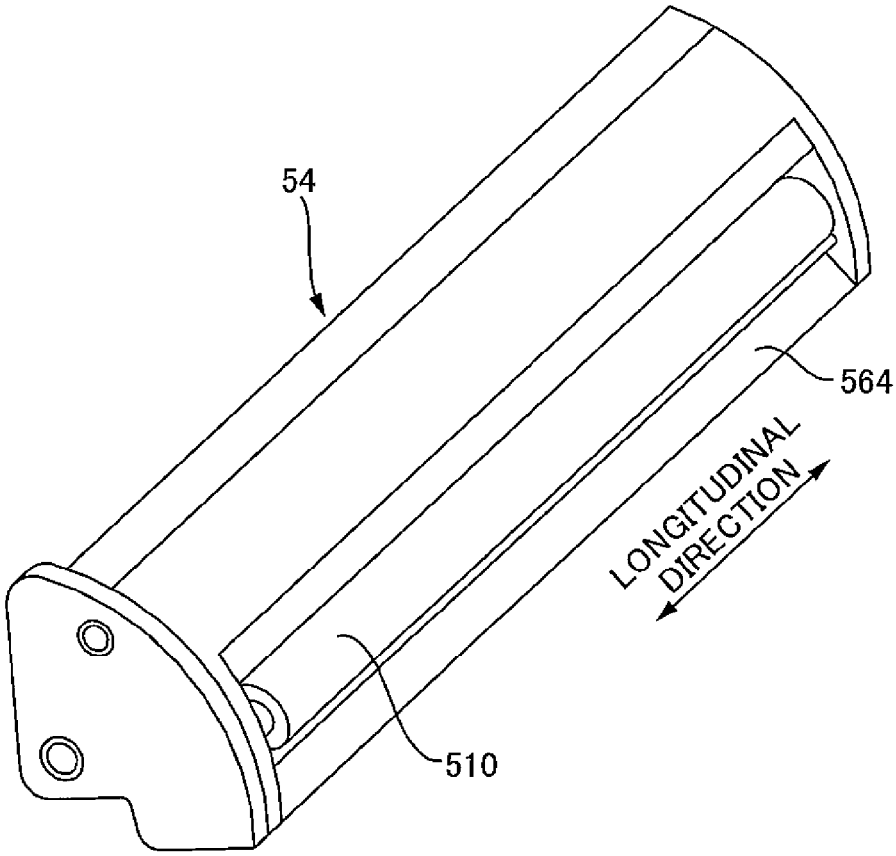
FIG. 4 shows a conceptual diagram of a developing device.
Figure 5:
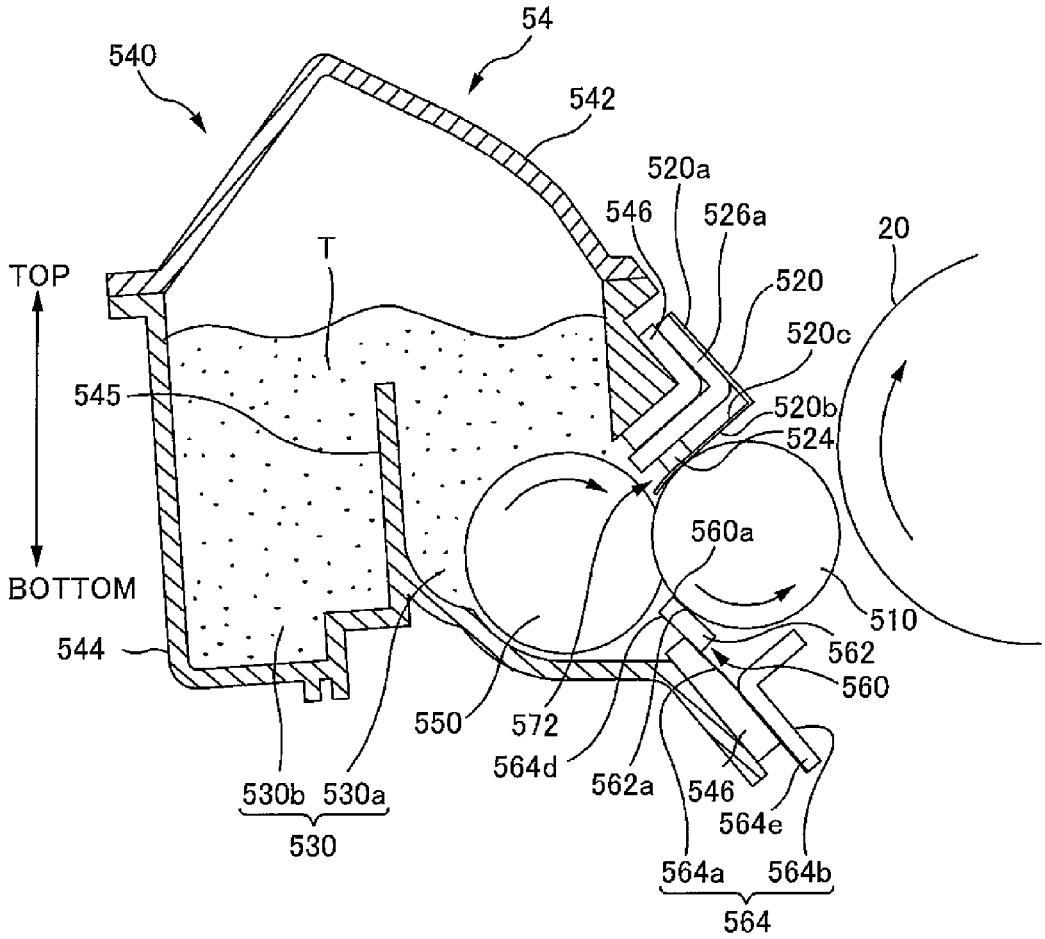
FIG. 5 is a cross-sectional view showing the main structural components of this developing device.
Figure 6:
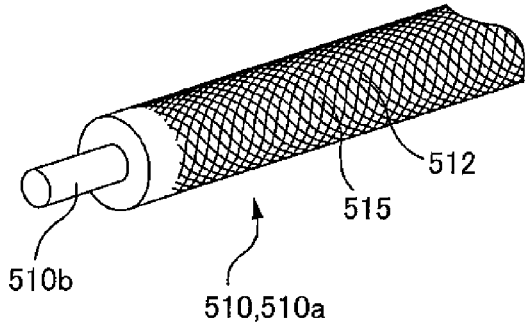
FIG. 6 is a schematic perspective view of a developing roller 510.
Figure 7:
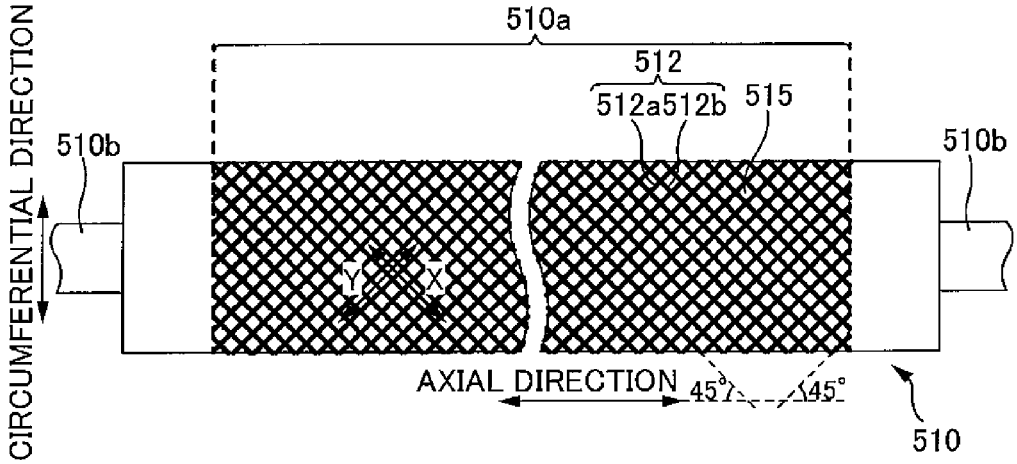
FIG. 7 is a schematic front view of the developing roller 510.
Figure 8:
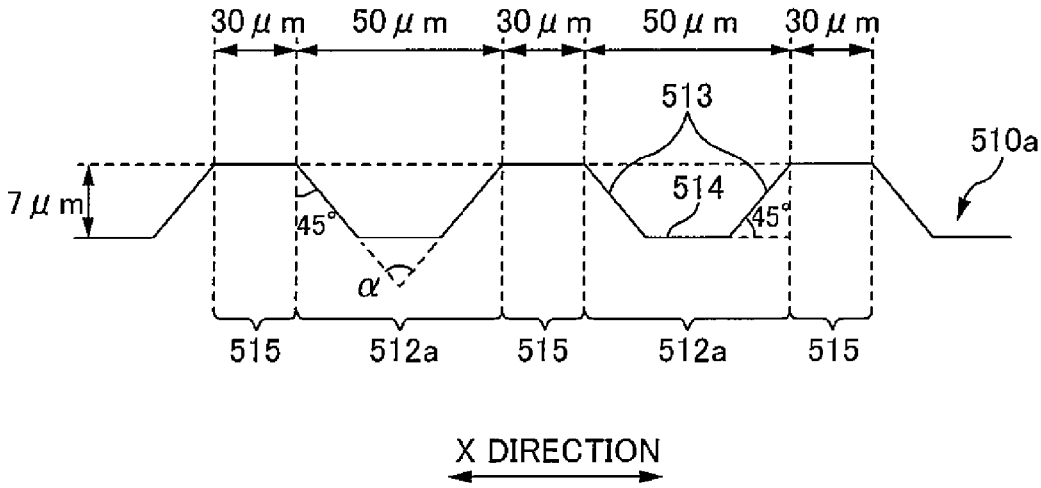
FIG. 8 is a schematic view showing the cross section of a groove section 512.
Figure 8:
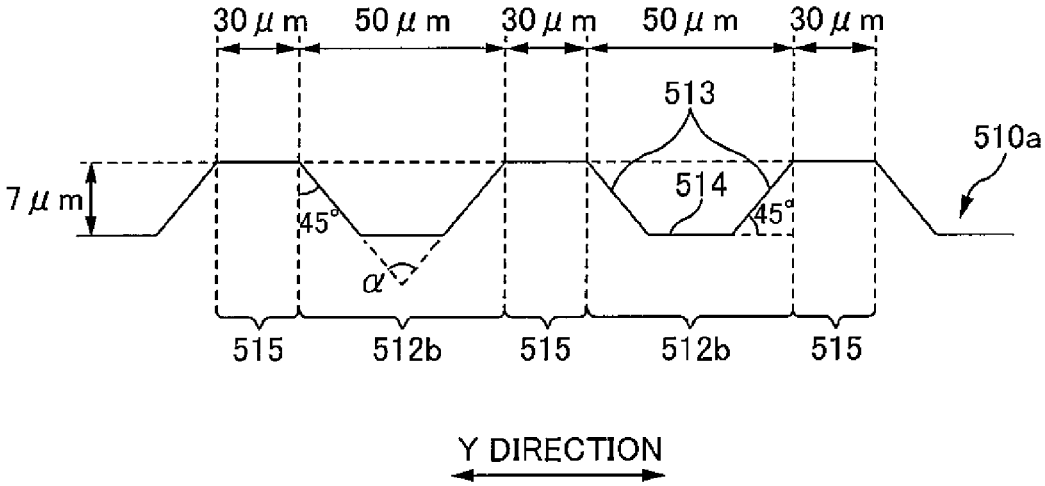
Figure 9:
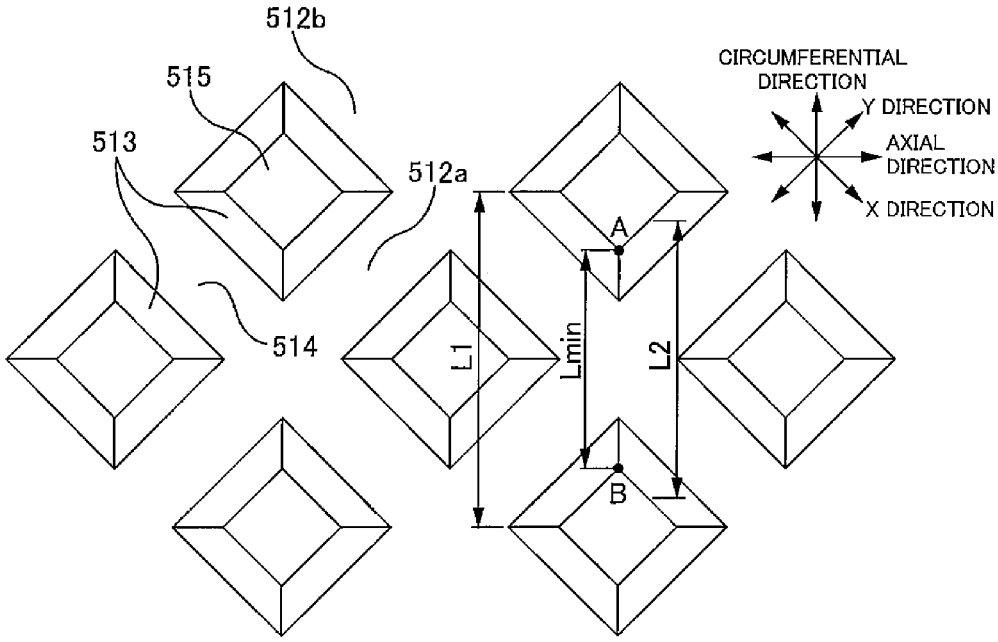
FIG. 9 is an enlarged schematic view of FIG. 7.
Figure 10:
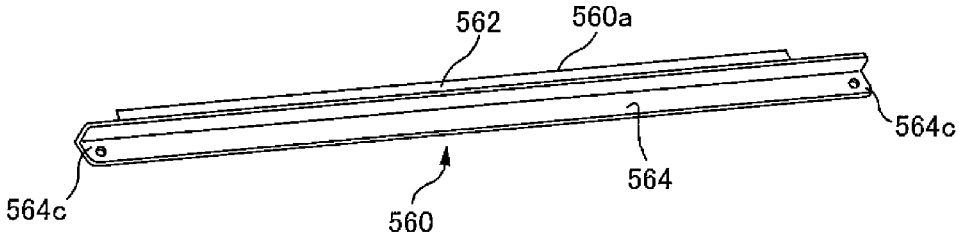
FIG. 10 is a perspective view of a regulating blade 560.
Figure 11:
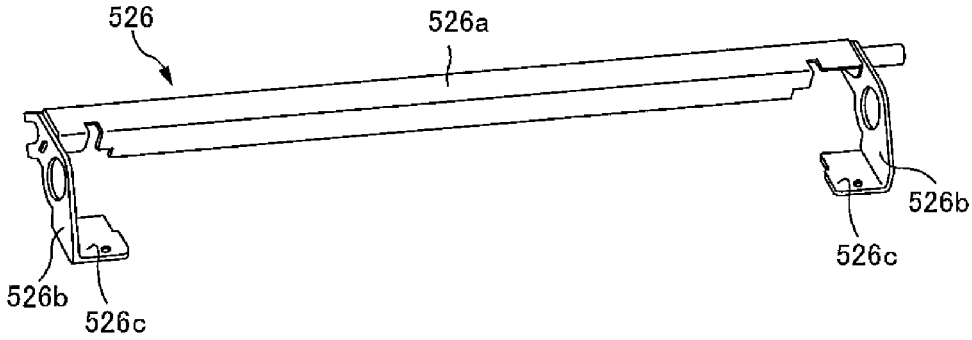
FIG. 11 is a perspective view of a holder 526.
Figure 12:
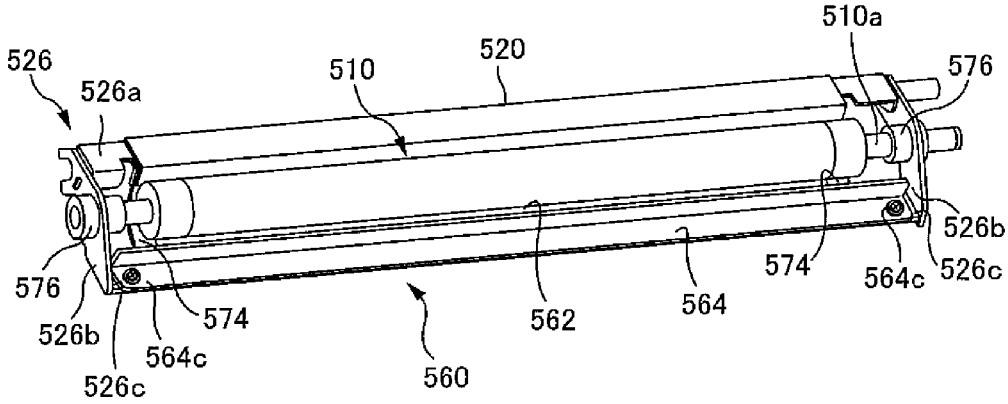
FIG. 12 is a perspective view illustrating the holder 526 to which an upper seal 520, the regulating blade 560 and the developing roller 510 are attached in an assembled manner.
Figure 13:
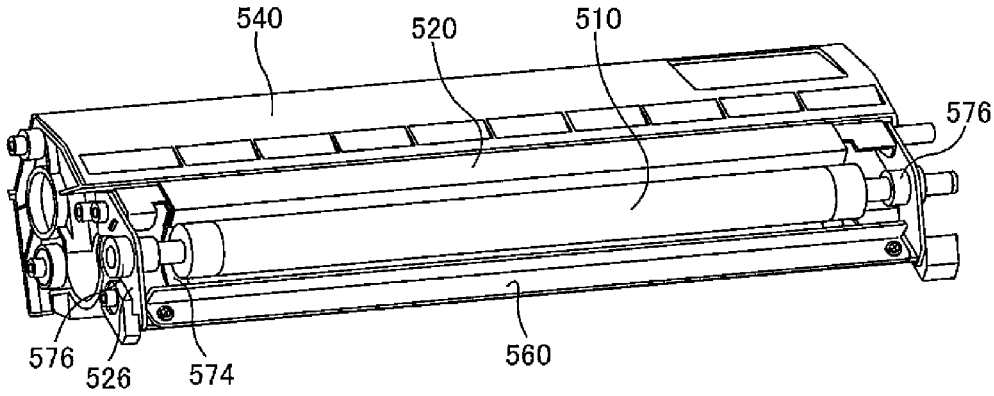
FIG. 13 is a perspective view illustrating the holder 526 attached to a housing 540.
Figure 14:
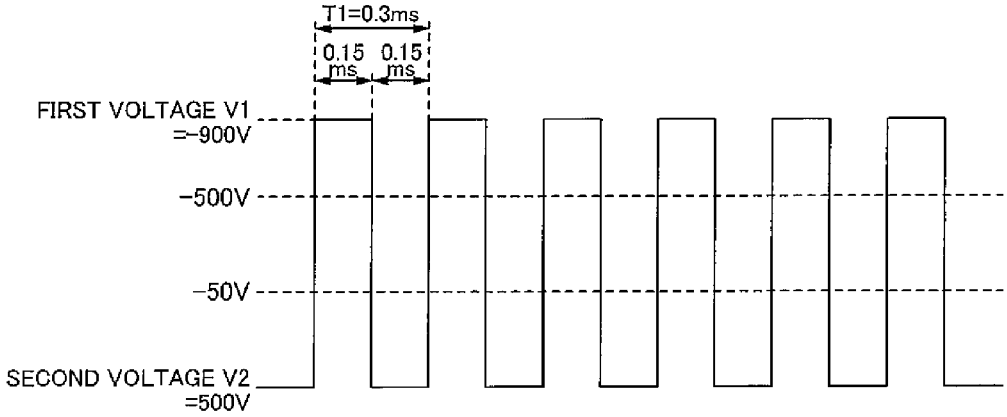
FIG. 14 is a schematic view showing a developing bias applied to the developing roller 510.

Next, the developing device is described with reference to FIGS. 4 through 14. FIG. 4 is a conceptual diagram of the developing device. FIG. 5 is a cross-sectional view showing the main structural components of the developing device. FIG. 6 is a perspective schematic view of the developing roller 510. FIG. 7 is a schematic front view of the developing roller 510. FIG. 8 is a schematic view showing the cross sectional shape of a groove section 512. FIG. 9 is an enlarged schematic view of FIG. 7, and shows the groove section 512 and a top surface 515. FIG. 10 is a perspective view of a regulating blade 560. FIG. 11 is a perspective view of a holder 526. FIG. 12 is a perspective view illustrating the holder 526 to which an upper seal 520, the regulating blade 560 and the developing roller 510 are attached in an assembled manner. FIG. 13 is a perspective view illustrating the state in which the holder 526 is attached to a housing 540. FIG. 14 is a schematic view showing a developing bias applied to the developing roller 510. It should be noted that the cross-sectional view shown in FIG. 5 shows the cross section obtained by cutting the developing device with a plane perpendicular to the longitudinal direction of the developing device shown in FIG. 4. Further, in FIG. 5, the arrows indicate the vertical directions as in FIG. 1, and, for example, a center axis of the developing roller 510 is located below the center axis of the photoconductor 20. Also, in FIG. 5, the yellow developing device 54 is shown in a state which is positioned at the developing position opposing the photoconductor 20. Also in FIGS. 6 to 9, the scale of the groove section 512 and the like are different from the actual scale in order to make the figures simple.

The YMCK developing unit 50 is provided with the black developing device 51 containing a black (K) toner, the magenta developing device 52 containing a magenta (M) toner, the cyan developing device 53 containing a cyan (C) toner, and the yellow developing device 54 containing a yellow (Y) toner. However, since the configuration of each of the developing devices is the same, only the yellow developing device 54 is explained below.

The yellow developing device 54 includes the developing roller 510, which is an example of a developer bearing member, the upper seal 520, a toner containing member 530, the housing 540, a toner supply roller 550, and the regulating blade 560, and the holder 526 or the like.

The developing roller 510 transports the toner T to the opposite position opposing the photoconductor 20 (developing position) by rotating with the toner T borne thereon. The developing roller 510 is a member composed of aluminum alloy, iron alloy or the like.

The developing roller 510 includes the groove section 512, as an example of a concave section, on the surface of a central portion 510*a* thereof in order to bear the toner T in an appropriate manner, as shown in FIGS. 6 and 7. In the present embodiment, two types of helical groove sections 512 having different spiral directions, namely, a first groove section 512*a* and a second groove section 512*b*, are provided as the groove section 512. As shown in FIG. 7, the tilted angle with respect to the circumferential direction of the developing roller 510 of the first groove section 512*a* and the second groove section 512*b* differ from each other, and both the size of an acute angle formed by the longitudinal direction of the first groove section 512*a* and the axial direction of the developing roller 510, and the size of an acute angle formed by the longitudinal direction of the second groove section 512*b* and the axial direction are approximately 45 degrees. As shown in FIG. 8, the width in X direction of the first groove section 512*a* and the width in Y direction of the second groove section 512*b* are approximately 50 μm, the depth of the groove section 512 is approximately 7 μm, and the groove angle (angle indicated with the symbol a in FIG. 8) is approximately 90 degrees.

Further, the groove section 512 includes a bottom surface 513 and a lateral surface 514. In the present embodiment, the tilted angle of the lateral surface 514 is approximately 45 degrees (see FIG. 8).

As shown in FIGS. 6, 7 and 9, the two types of helical groove sections 512 configured in such way are regularly disposed on the surface of the central portion 510*a* of the developing roller 510, and mutually intersect so as to form a grid pattern. Consequently, a large number of rhomboid-shaped top surfaces 515 surrounded by the groove sections 512 are formed in the central portion 510*a* in a grid pattern.

As described above, in the present embodiment, size of the acute angle formed by the longitudinal direction of the first groove section 512*a* and the axial direction, and size of the acute angle formed by the longitudinal direction of the second groove section 512*b* and the axial direction are both approximately 45 degrees. Therefore, the top surface 515 is in a form of a plane square shape. In addition, one (the other) of two diagonal lines of the top surface 515 is along the circumferential direction (axial direction) of the developing roller 510. It should be noted that the length of one side of the square top surface 515 is, as shown in FIG. 8, approximately 30 μm.

Further, the developing roller 510 is provided with a shaft section 510*b*. The developing roller 510 is rotatably supported as a result of the shaft section 510*b* being supported via a bearing 576 by a developing roller support section 526*b* of the holder 526 which is described later (FIG. 12). As shown in FIG. 5, the developing roller 510 rotates in a direction (counterclockwise direction in FIG. 5) opposite to the rotation direction of the photoconductor 20 (clockwise direction in FIG. 5). In the present embodiment, a moving velocity V of the surface of the developing roller 510 during rotation thereof (that is, the linear velocity of the developing roller 510 on the surface thereof) is 300 mm/s. The moving velocity of the surface of the photoconductor 20 during rotation thereof (that is, the linear velocity of the photoconductor 20 on the surface thereof) is 210 mm/s. Thus the circumferential velocity ratio of the developing roller 510 to the photoconductor 20 is approximately 1.4.

In a state in which the yellow developing device 54 opposes the photoconductor 20, there is a gap between the developing roller 510 and the photoconductor 20. That is, the yellow developing device 54 develops the latent image formed on the photoconductor 20 in a non-contacting state. Further, the printer 10 of the present embodiment employs the jumping development method, and during the development of the latent image formed on the photoconductor 20, an alternating electric field is formed between the developing roller 510 and the photoconductor 20 (described in detail later on).

The housing 540 is manufactured by welding together a plurality of integrally-molded resin housing sections, that is, an upper housing section 542 and a lower housing section 544. A toner containing member 530 for containing toner T is formed inside the housing 540. The toner containing member 530 is divided by a partitioning wall 545 for partitioning the toner T, which protrudes inwards (in the vertical direction of FIG. 5) from the inner wall, into two toner containing sections, namely, a first toner containing section 530*a* and a second toner containing section 530*b*. The first toner containing section 530*a* and the second toner containing section 530*b* are in communication at the top, and in the state shown in FIG. 5, the movement of the toner T is regulated by the partitioning wall 545. However, when the YMCK developing unit 50 rotates, the toner contained in the first toner containing section 530*a* and the second toner containing section 530*b* is temporarily collected on the side where the top sides are in communication in the developing position, and when it returns to the state shown in FIG. 5, the toner is mixed and returned to the first toner containing section 530*a* and the second toner containing section 530*b*. That is to say, by rotating the YMCK developing unit 50, the toner T in the developing device is suitably stirred.

Therefore, in this embodiment, the toner containing member 530 is not provided with a stirring member, however it is also possible to provide a stirring member for stirring the toner T contained in the toner containing member 530. Moreover, as shown in FIG. 5, the housing 540 (that is, the first toner containing section 530*a*) has an aperture 572 at its lower portion, and the developing roller 510 is arranged such that it faces this aperture 572.

The toner supply roller 550 is provided in the first toner containing section 530*a* described above and supplies the toner T contained in the first toner containing section 530*a* to the developing roller 510. Also, the toner supply roller 550 scrapes off the toner T remaining on the developing roller 510 after developing from the developing roller 510. The toner supply roller 550 is made of polyurethane foam or the like, and contacts against the developing roller 510 in a state of elastic deformation. The toner supply roller 550 is disposed at a lower portion of the first toner containing section 530*a*, and the toner T contained in the first toner containing section 530*a* is supplied to the developing roller 510 by the toner supply roller 550 at the lower portion of the first toner containing section 530*a*. The toner supply roller 550 is rotatable about its center axis, and its center axis is located below the center axis of rotation of the developing roller 510. Also, the toner supply roller 550 rotates in a direction (clockwise direction in FIG. 5) opposite to the rotation direction of the developing roller 510 (counterclockwise direction in FIG. 5).

The upper seal 520 contacts against the developing roller 510 along its axial direction, allows the movement of toner T that has remained on the developing roller 510 after passing the developing position into the housing 540, and restricts the movement of the toner T inside the housing 540 to the outside of the housing 540. The upper seal 520 is a seal made of polyethylene film or the like. The upper seal 520 is supported by an upper seal support section 526*a* of the holder 526 described later, and is provided such that its longitudinal direction extends along the axial direction of the developing roller 510 (FIG. 12). The contact position where the upper seal 520 contacts against the developing roller 510 is located above the center axis of the developing roller 510.

Moreover, an upper seal biasing member 524 made of an elastic member such as Moltopren is provided in a compressed state between the upper seal support section 526*a* and the surface of the upper seal 520 that is on the side facing away from the contact surface 520*b* contacting against the developing roller 510 (this surface is also referred to as "opposite surface 520*c*"). This upper seal biasing member 524 presses the upper seal 520 against the developing roller 510 by biasing the upper seal 520 toward the developing roller 510 with its biasing force.

The regulating blade 560 contacts at a contacting section 562*a* against the developing roller 510 from a one end portion to the other end portion in the axial direction of the developing roller 510, and regulates the layer thickness of the toner T borne by the developing roller 510. Moreover, it applies a charge to the toner T borne by the developing roller 510. As shown in FIGS. 5 and 10, the regulating blade 560 includes a rubber section 562 and a rubber support section 564.

The rubber section 562 is made of silicon rubber, urethane rubber or the like, and contacts against the developing roller 510.

The rubber support section 564 is made of a thin plate 564*a* and a thin plate support section 564*b*, and supports the rubber section 562 at a one end portion 564*d* in its transverse direction (that is, at an end portion on the side of the thin plate 564*a*). The thin plate 564*a* is made of phosphor bronze, stainless steel or the like, and has spring property. The thin plate 564*a* supports the rubber section 562 and presses the rubber section 562 using its biasing force against the developing roller 510. The thin plate support section 564*b* is a sheet metal arranged on the other end portion 564*e* in the transverse direction of the rubber support section 564. The thin plate support section 564*b* is attached to the thin plate 564*a* in a state in which it supports the thin plate 564*a* at the end that is on the opposite side from the side that supports the rubber section 562.

The regulating blade 560 is attached to regulating blade support sections 526*c* with both end portions 564*c* in the longitudinal direction of the thin plate support section 564*b* being supported with the regulating blade support sections 526*c* of the holder 526 described later.

The end of the regulating blade 560 on the side opposite to the side of the thin plate support section 564*b*, that is, its tip section 560*a*, is not in contact with the developing roller 510, but a portion thereof removed from this tip section 560*a* by a predetermined distance (that is, the contacting section 562*a*) is in contact with the developing roller 510 over a certain width. That is to say, the regulating blade 560 does not contact against the developing roller 510 at the edge, but contacts against it at its mid-portion, and the layer thickness is regulated by the plane of the regulating blade 560 contacting against the developing roller 510. Also, the regulating blade 560 is disposed such that its tip section 560*a* is facing upstream with respect to the direction in which the developing roller 510 rotates, and is in so-called counter contact. It should be noted that the contact position where the regulating blade 560 contacts against the developing roller 510 is located below the center axis of the developing roller 510, and is also located below the center axis of the toner supply roller 550. Moreover, the regulating blade 560 performs a function of preventing leakage of the toner T from the toner containing member 530 by contacting against the developing roller 510 along its axial direction.

Also as shown in FIG. 12, on the outer end portion in the longitudinal direction of the rubber section 562 of the regulating blade 560, an end portion seal 574 is provided. The end portion seal 574 is made of nonwoven fabric, and contacts the end portion in the axial direction of the developing roller 510 along the circumferential surface of the developing roller 510, so as to perform a function to prevent leakage of the toner T from a space between the circumferential surface thereof and the housing 540.

The holder 526 is a metal member on which various members such as the developing roller 510 are assembled. As shown in FIG. 11, it includes the upper seal support section 526*a* disposed along the longitudinal direction of the holder 526 (namely, the axial direction of the developing roller 510), the developing roller support section 526*b* that is provided on the outside in the longitudinal direction (the axial direction) of the upper seal support section 526*a* and intersects the longitudinal direction (the axial direction), and the regulating blade support section 526*c* that intersects the developing roller support section 526*b* and faces the end portion in the longitudinal direction of the upper seal support section 526*a*.

As shown in FIG. 12, the upper seal 520 is supported by the upper seal support section 526*a* at the end portion 520*a* in the transverse direction thereof (FIG. 5), and the developing roller 510 is supported by the developing roller support section 526*b* at its ends.

Further, the regulating blade 560 is supported by the regulating blade support sections 526*c* at its end portions 564*c* in the longitudinal direction of the regulating blade 560. The regulating blade 560 is fixed to the regulating blade support section 526*c* with screws so as to be fixed to the holder 526.

In this manner, the holder 526 on which the upper seal 520, the developing roller 510 and the regulating blade 560 are attached in an assembled manner, is attached to the above-described housing 540 via a housing seal 546 (FIG. 5) for preventing leakage of the toner T from a space between the holder 526 and the housing 540, as shown in FIG. 13.

In the yellow developing device 54 configured in this manner, the toner supply roller 550 supplies the toner T contained in the toner containing member 530 to the developing roller 510. With the rotation of the developing roller 510, the toner T that is supplied to the developing roller 510 is brought to the contact position of the regulating blade 560, and when it passes that contact position, the layer thickness of the toner T is regulated, and a negative charge is applied to it (charged to the negative polarity). The toner T on the developing roller 510 charged to the negative polarity, whose layer thickness has been regulated, is transported to the opposing position opposing the photoconductor 20 (developing position) due to further rotation of the developing roller 510, and is supplied for developing the latent image formed on the photoconductor 20 at the opposing position.

Here, development of the latent image is described with reference to FIG. 14. As described above, the printer 10 of the present embodiment employs the jumping development method. When the jumping developing is carried out, the alternating voltage applying section 132 applies a square alternating voltage to the developing roller 510. The alternating voltage includes a first voltage V1 and a second voltage V2, as shown in FIG. 14.

The first voltage V1 is voltage for moving a toner from the developing roller 510 to the photoconductor 20, and its value is −900 V. In the present embodiment, as shown in FIG. 14, during development, the potential of the photoconductor 20 is −500 V for a non-image area (a portion corresponding to a white image) and −50 V for an image area (a portion corresponding to black image), and moreover, the toner is charged to negative polarity. Therefore, when the first voltage V1 is applied to the developing roller 510, an electrical field that moves a toner from the developing roller 510 to the photoconductor 20 is formed between the developing roller 510 and the photoconductor 20. As a result, the toner on the developing roller 510 moves toward the photoconductor 20.

On the other hand, the second voltage V2 is voltage for moving a toner from the photoconductor 20 to the developing roller 510, and its value is 500 V. When the second voltage V2 is applied to the developing roller 510, an electrical field that moves a toner from the photoconductor 20 to the developing roller 510 is formed between the developing roller 510 and the photoconductor 20. As a result, the toner on the photoconductor 20 moves toward (is drawn back to) the developing roller 510.

As shown in FIG. 14, since the first voltage V1 and the second voltage V2 are applied alternately by the alternating voltage applying section 132, during development of latent images, the toner alternately repeats moving from the developing roller 510 to the photoconductor 20, and moving (returning) from the photoconductor 20 to the developing roller 510.

In the present embodiment, the period during which the alternating voltage applying section 132 continuously applies the first voltage V1 and the period during which the alternating voltage applying section 132 continuously applies the second voltage V2 are both 0.1 ms (namely, duty ratio is 50%). Accordingly, the cycle period of alternating voltage (this cycle period is referred to as a "cycle T1") is 0.2 ms (see FIG. 14). Also, the average voltage that the alternating voltage applying section 132 applies to the developing roller 510 is higher than the potential for the non-image area (−500 V) and lower than the potential for the image area (−50 V), which is −200 V (=(−900+500)/2).

The toner T on the developing roller 510 that has passed the developing position due to rotation of the developing roller 510 passes the upper seal 520 and is collected inside the developing device without being scraped off by the upper seal 520. Moreover, the toner T that is still remaining on the developing roller 510 can be scraped off by the toner supply roller 550.

Relationship Between the Width of the Groove Section 512 and the Cycle Period of Alternating Voltage As already described, regularly disposed concave sections are sometimes provided on the surface of the developing roller 510 such that a sufficient amount of toner is borne on the surface of the developing roller 510 (in other words, in order to ensure a sufficiently large surface area for the surface on which a toner is borne), or for other reasons. The developing roller 510 of the present embodiment also has the groove section 512 as an example of the concave section.

However, a toner tends to be stuck in the groove section 512, where the rollability of toner tends to be unfavorable. In addition, when the regulating blade 560 is provided as a charging member for charging a toner borne on the developing roller 510 by contacting against the developing roller 510, as the printer 10 of the present embodiment, the force of the regulating blade 560 for pressing against a toner becomes weaker at the groove section 512 (compared with the top surface 515), which may invite inappropriate frictional charging.

For this reason, a toner at the groove section 512 tends to suffer insufficient charging. As a result, such a toner may cause so-called fog.

In contrast, in the printer 10 of the present embodiment, the above-described cycle period (cycle T1) of the alternating voltage (developing bias) is smaller than or equal to a value obtained by dividing a minimum width Lmin of the groove section 512 in the circumferential direction of the developing roller 510 by the moving velocity V of the surface of the developing roller 510 during rotation thereof (T1≦Lmin/V). Accordingly, with the printer 10 of the present embodiment in which the width of the groove section 512 and the cycle period of the developing bias satisfy the above-described condition, it is possible to appropriately prevent occurrence of fog.

This is described in detail below with reference to FIGS. 9 and 15. As described above, the two kinds of helical groove sections 512 having different inclination angles with respect to the circumferential direction are provided on the surface of the developing roller 510 of the present embodiment, and these two kinds of helical groove sections 512 mutually intersect so as to form a grid pattern. Also, the developing roller 510 has the square-shaped top surfaces 515 surrounded by the two kinds of helical groove sections 512, and one of two lines of the square-shaped top surface is along the circumferential direction of the developing roller 510 (FIG. 9). In the developing roller 510 (as shown in FIG. 9), while the width of the groove section 512 in the circumferential direction of the developing roller 510 may be defined in various manners, such as a width L1, width L2, the minimum width is the width Lmin shown in FIG. 9 (distance between the points A and B in FIG. 9). It should be noted that the value of the width Lmin is approximately 70.71 μm.

In addition, as described above, the moving velocity V of the surface of the developing roller 510 during rotation thereof is 300 mm/s. Therefore, the value Lmin/V, which is obtained by dividing the minimum width Lmin by the moving velocity V of the surface of the developing roller 510 during rotation thereof is approximately 0.236 ms. As shown in FIG. 14, since the cycle period of the developing bias (cycle T1) is 0.2 ms, the condition of T1≦Lmin/V is satisfied in the present embodiment.

Next, the reason why occurrence of fog can be appropriately prevented when the condition of T1≦Lmin/V is satisfied is described with reference to FIG. 15.

Figure 15:
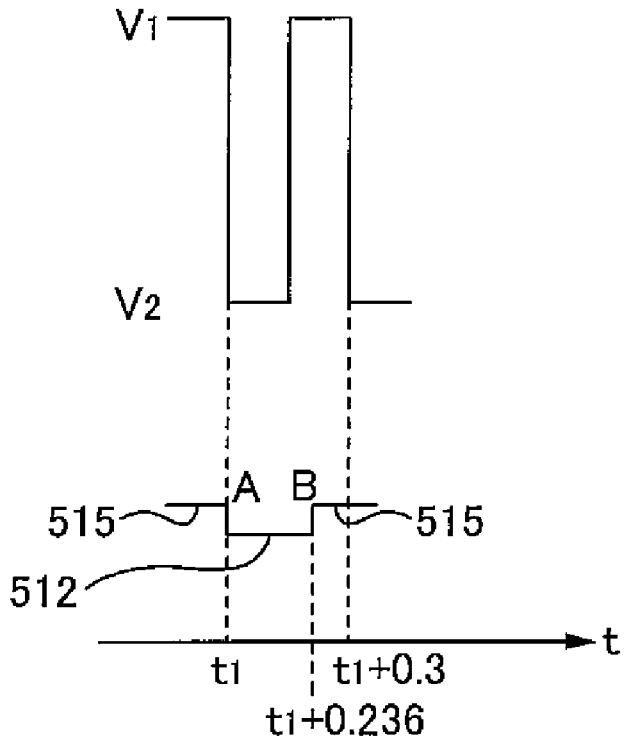
FIG. 15 is an explanatory diagram for describing superiority of the printer 10 of the present embodiment.

In FIG. 15, from the top, two figures (respectively referred to as an "upper figure" and a "lower figure") and the time axis are shown.

Here, the lower figure in FIG. 15 shows which portion of the developing roller 510 is located at the opposing position opposing the photoconductor 20 at a certain time t while the latent image is being developed. For example, during development of the latent image, when the portion indicated with the symbol A in FIG. 9 is positioned at the opposing position at time t1, approximately 0.236 ms (=Lmin/v) after the time t1, the portion indicated with the symbol B in FIG. 9 will be positioned at the opposing position due to rotation of the developing roller 510. Specifically, the lower figure shows that it requires approximately 0.236 ms for the groove section 512 (between the points A and B) of the developing roller 510 to pass through the opposing position.

On the other hand, since the cycle period (0.2 ms) of the developing bias is smaller than or equal to Lmin/V (0.236 ms), during development of the latent image, one cycle's worth of developing bias is applied to the developing roller 510 without fail while the groove section 512 (between the points A and B) of the developing roller 510 passes through the opposing position (see the upper figure in FIG. 15).

In other words, in the printer 10 of the present embodiment, while the groove section 512, which bears a comparatively large amount of fog-causing toner, passes through the opposing position, not only the first voltage V1 for moving a toner from the developing roller 510 to the photoconductor 20, but also the second voltage V2 for drawing back a toner from the photoconductor 20 to the developing roller 510 are certainly applied to the groove section 512. Therefore, the function of the second voltage V2 for drawing back a toner facilitates drawing back the fog-causing toner that moves from the groove section 512 and attaches to the non-image area (portion corresponding to white image) of the photoconductor 20 to the developing roller 510 side. As a result, occurrence of fog can be appropriately prevented.

Density Unevenness Due to the Developing Bias and the Charging Bias

As described above, an alternating voltage (developing bias) including the first voltage V1 and the second voltage V2 is applied to the developing roller 510. It is known that density unevenness occurs in images due to this developing bias. This density unevenness is likely to occur in each cycle period of the developing bias (cycle T1) respectively. Similarly, a superimposed voltage (charging bias) in which DC voltage and AC voltage are superimposed is applied to the charging roller 31. It is known that density unevenness occurs in images due to the AC voltage component of the charging bias. Furthermore, the density unevenness is likely to occur in each cycle period of the charging bias (cycle T2). And when these two types of density unevenness occur, if the two types of density unevenness occur at the same location, the density unevenness becomes conspicuous, and consequently the density unevenness in images becomes easily noticeable.

Figure 16A:
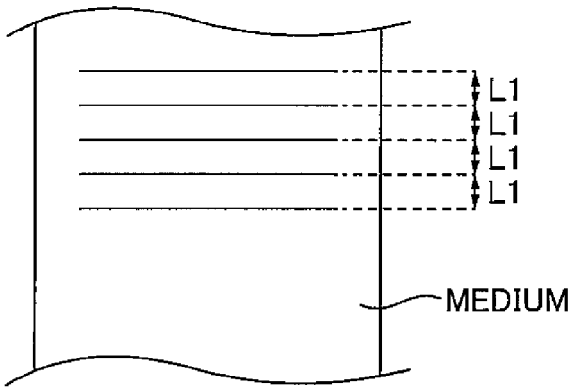
FIG. 16A is a schematic view illustrating density unevenness due to the developing bias.
Figure 16B:
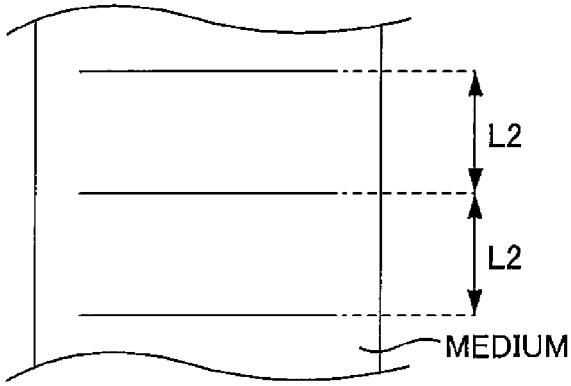
FIG. 16B is a schematic view illustrating density unevenness due to the charging bias.
Figure 16C:
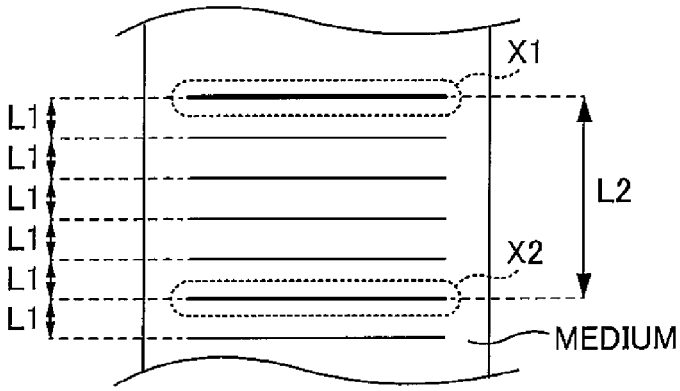
FIG. 16C is a schematic view illustrating a state in which the degree of density unevenness has been strengthened.

This phenomenon is described specifically with reference to the comparative examples shown in FIGS. 16A to 16C.

FIG. 16A is a schematic view illustrating density unevenness due to the developing bias. FIG. 16B is a schematic view illustrating density unevenness due to the charging bias. FIG. 16C is a schematic view illustrating a state in which the degree of density unevenness has been strengthened.

The density unevenness due to developing bias occurs in every predetermined interval L1, as shown in FIG. 16A. This predetermined interval L1 is a value obtained by multiplying the moving velocity of the photoconductor 20 by the cycle T1 of the developing bias. Similarly, the density unevenness due to charging bias occurs in every predetermined interval L2, as shown in FIG. 16B. This predetermined interval L2 is a value obtained by multiplying the moving velocity of the photoconductor 20 by the cycle T2 of the charging bias. And these two types of density unevenness occur independently.

In addition, when forming an image, the initial occurrence position of the density unevenness due to developing bias and the initial occurrence position of the density unevenness due to charging bias may coincide (the region X1 surrounded by the dotted line in FIG. 16C), and when the occurrence positions of the two kinds of density unevenness coincide, the density unevenness becomes conspicuous. In such a case, for example, when the cycle T1 of the developing bias is the same as a value obtained by dividing the cycle T2 of the charging bias by any positive integer, it is probable that subsequent occurrence positions of the density unevenness due to the charging bias and occurrence positions of the density unevenness due to the developing bias coincide in succession (the region X2 surrounded by the dotted line in FIG. 16C). Therefore, the density unevenness becomes further conspicuous in every predetermined interval L2, and consequently the density unevenness becomes easily noticeable.

On the other hand, in the printer 10 of the present embodiment, as shown in FIGS. 3B and 14, the above-described cycle T1 (0.2 ms) of the developing bias is neither a value obtained by multiplying the cycle T2 (0.9 ms) of the charging bias by any positive integer, nor a value obtained by dividing the cycle T2 by any positive integer. That is, the condition of $T1 \neq nT2$ is true for T1 and T2 (where, n is a positive integer or a reciprocal of positive integer). Although in such a case, the occurrence position of the density unevenness due to developing bias and the occurrence position of the density unevenness due to charging bias may coincide, even if the occurrence positions of the two types of density unevenness coincide, unlike the above-described case of a comparative example, it is possible to prevent successive coincidence of subsequent occurrence positions of the density unevenness due to developing bias and occurrence positions of the density unevenness due to charging bias. Consequently, it is possible to prevent the density unevenness in images from becoming conspicuous.

In this manner, in the printer 10 of the present embodiment in which the cycle T1 of the developing bias and the cycle T2 of the charging bias satisfy the above-described condition, it is possible to prevent the density unevenness in images from becoming conspicuous.

Control to Change the Cycle Periods of the Developing Bias and the Charging Bias As described above, the printer 10 can form images on media. As types of media, for example, there are special paper such as thick paper or OHP transparency, and plain paper. The printer 10 changes the processing speed of the printer (for example, the moving velocity of the surface of the photoconductor 20, the moving velocity V of the surface of the developing roller 510 and the like) depending on the type of a medium, such that images are appropriately formed depending on the type of the medium. Specifically, the printer 10 increases the processing speed when forming an image on the plain paper, and decreases the processing speed when forming an image on the special paper.

The printer 10 of the present embodiment performs control for changing the cycle period of the developing bias and the cycle period of the charging bias when the processing speed of the printer is changed depending on the type of the medium (as a result, the moving velocity V of the surface of the developing roller 510 is also changed), so as to appropriately prevent occurrence of fog, and suppress density unevenness in images from becoming conspicuous. Specifically, the control unit 100 (1) changes the cycle period of the developing bias (hereinafter referred to as the "cycle T1") such that the changed cycle T1 is smaller than or equal to a value obtained by dividing the minimum width Lmin of the groove section 512 in the circumferential direction of the developing roller 510 by the moving velocity V changed accordingly, and (2) changes the cycle period of the charging bias (hereinafter referred to as the "cycle T2") such that the changed cycle T1 of the developing bias is neither a value obtained by multiplying the changed cycle T2 by any positive integer, nor a value obtained by dividing the changed cycle T2 by any positive integer.

Figure 17:
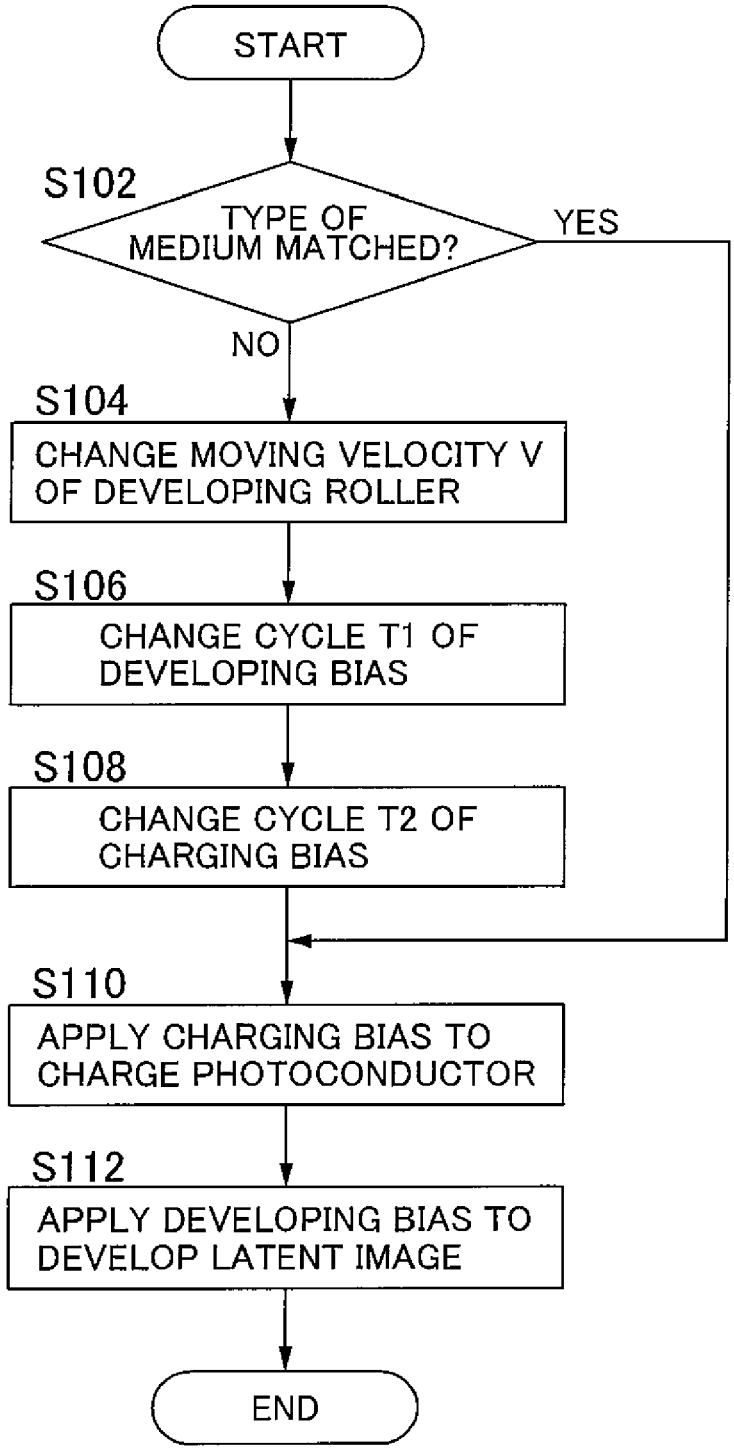
FIG. 17 is a flowchart for describing operations of control of the printer 10.

In the following, an operational example for the above-described control of the printer 10 is explained with reference to FIG. 17. FIG. 17 is a flowchart for describing operations for the above-described control of the printer 10.

Various operations performed to execute the above-described operations of the printer 10 are mainly realized by the control unit 100. In particular, in the present embodiment, the operations are realized by the CPU executing programs stored in a ROM. These programs are constituted by program code for performing various operations described below.

This control is executed when the printer 10 is inputted with an image signal and a control signal from a computer, which is an external apparatus. This control signal includes information on the type of a medium selected by the user or the like (specifically, one of "plain paper", "thick paper" and "OHP transparency").

First, the control unit 100 determines whether the type of the medium included in the control signal matches the predetermined type of medium (in this case, the predetermined type of medium is assumed to be "plain paper") (Step S102).

In this example, the type of the medium included in the control signal is assumed to be "thick paper". In such a case, since the type of the medium included in the control signal ("thick paper") does not match the predetermined type of medium ("plain paper") ("No" in step S102), the control unit 100 changes the processing speed (moving velocity V of the developing roller 510) (step S104).

FIG. 18 is a table showing the relationship between the type of media and the moving velocity V of the developing roller 510 and the like, which is stored in ROM or the like of the control unit 100. As can be understood from the table, the moving velocity V of the developing roller 510 in forming images on "plain paper" is 300 mm/s, the moving velocity V of the developing roller 510 in forming images on "thick paper" is 225 mm/s, and the moving velocity V of the developing roller 510 in forming images on "OHP transparency" is 150 mm/s.

In this example, since images are formed on "thick paper", the control unit 100 changes the moving velocity V of the developing roller 510 from 300 mm/s to 225 mm/s.

When the moving velocity V of the developing roller 510 is changed, the control unit 100 changes the cycle T1 of the developing bias and the cycle T2 of the charging bias (steps S106 and S108).

In the table shown in FIG. 18, the relationship between the type of media and the cycle T1 of the developing bias and the cycle T2 of the charging bias is shown. For example, when the moving velocity V of the developing roller 510 is 225 mm/s, the cycle T1 of the developing bias is 0.25 ms, and the cycle T2 of the charging bias is 1.1 ms. And as can be understood from the table, as the moving velocity V of the developing roller 510 decreases, the cycle T1 of the developing bias and the cycle T2 of the charging bias increase.

In this example, the moving velocity V of the developing roller 510 is changed from 300 mm/s to 225 mm/s. Accordingly, due to change in the moving velocity V of the developing roller 510, the control unit 100 changes the cycle T7 of the developing bias from 0.2 ms to 0.25 ms, and changes the cycle T2 of the charging bias from 0.9 ms to 1.1 ms.

Incidentally, as described above, when the moving velocity V of the developing roller 510 is 300 mm/s, the cycle T1 (0.2 ms) of the developing bias and the cycle T2 (0.9 ms) of the charging bias satisfy two expressions (that is, $T1 \leqq Lmin/V$, and $T1 \neq nT2$). And, the cycle T1 of the developing bias and the cycle T2 of the charging bias are set such that these two expressions are true for both cases in which the moving velocity V of the developing roller 510 is 225 mm/s and the moving velocity V is 150 mm/s. For this reason, even though the moving velocity V of the developing roller 510 is changed depending on the type of media (for example, is changed from 300 mm/s to 225 mm/s), these cycle periods are changed to the cycle T1 of the developing bias (0.25 ms) and the cycle T2 of the charging bias (1.1 ms) so as to satisfy the above two expressions (that is, $T1 \leqq Lmin/V$, and $T1 \neq nT2$). Therefore, it becomes possible to appropriately prevent occurrence of fog and suppress conspicuous density unevenness in images.

Returning to the flowchart in FIG. 17, the description of operations of the printer 10 for the above-described control is continued.

The control unit 100 applies a charging bias to the charging roller 31 to charge the photoconductor 20 (step S110). In this example, the superimposed voltage applying section 133 applies a charging bias whose cycle T2 was changed to 1.1 ms in step S108 to the rotating charging roller 31, so as to charge the photoconductor 20.

Next, the control unit 100 applies a developing bias to the developing roller 510 to develop a latent image on the photoconductor 20 (step S112). In this example, the alternating voltage applying section 132 applies a developing bias whose cycle T1 was changed to 0.25 ms in step S106 to the rotating developing roller 510, so as to develop the latent image.

In the above description, although the control unit 100 changed the moving velocity V of the developing roller 510, when the type of the medium included in the control signal matches the predetermined type of medium ("plain paper") ("Yes" in step S102), the control unit 100 does not change the moving velocity V of the developing roller 510. In such a case, the control unit 100 does not change the cycle T1 of the developing bias or the cycle T2 of the charging bias. In other words, the moving velocity V of the developing roller 510 is 300 mm/s, and the cycle T1 of the developing bias is 0.2 ms and the cycle T2 of the charging bias is 0.9 ms. Then, the charging roller 31 is charged by the superimposed voltage applying section 133 applying a charging bias whose cycle T2 is 0.9 ms (step S110), and the latent image is developed by the alternating voltage applying section 132 applying a developing bias whose cycle T1 is 0.2 ms (step S112).

At this time as well, the above two expressions (that is, $T1 \leqq Lmin/V$, and $T1 \neq nT2$) are satisfied, and therefore it is possible to appropriately prevent occurrence of fog and suppress conspicuous density unevenness in images.

Method for Manufacturing the Developing Device

Here, the method for manufacturing the developing device is described with reference to FIGS. 19A to 21. FIGS. 19A to 19E are schematic views of the transitional states of the developing roller 510 during the manufacturing process of the developing roller 510. FIG. 20 is an explanatory diagram for describing a rolling process of the developing roller 510. FIG. 21 is a flowchart for describing an assembly method for the yellow developing device 54. It should be noted that in manufacturing the developing device, the above-described housing 540, holder 526, developing roller 510, toner supply roller 550, regulating blade 560 and the like are manufactured first, and after that, the developing device is manufactured by assembling these members. Here, among manufacturing methods for these members, the method for manufacturing the developing roller 510 is described first, and thereafter the method for assembling the developing device is described. In the following description, of the black developing device 51, magenta developing device 52, cyan developing device 53 and yellow developing device 54, the yellow developing device 54 is taken as an example.

Method for Manufacturing the Developing Roller 510

Figure 19A:
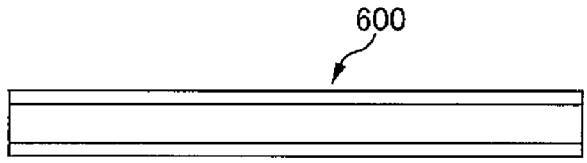
FIG. 19A is a schematic view showing a transitional state (1) of the developing roller 510 during the manufacturing process of the developing roller 510.
Figure 19B:
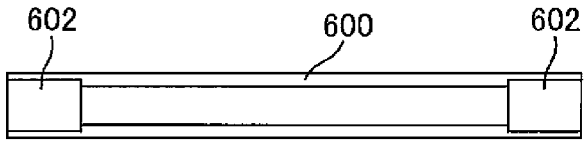
FIG. 19B is a schematic view showing a transitional state (2) of the developing roller 510 during the manufacturing process of the developing roller 510.
Figure 19C:
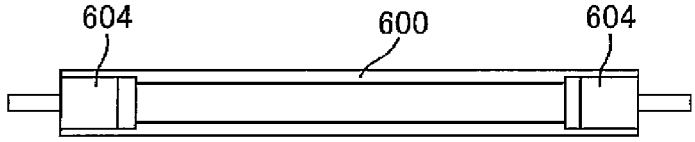
FIG. 19C is a schematic view showing a transitional state (3) of the developing roller 510 during the manufacturing process of the developing roller 510.
Figure 19D:
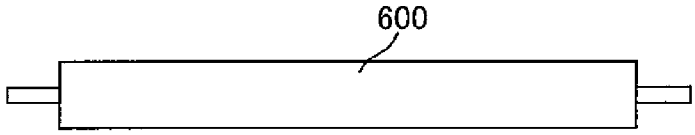
FIG. 19D is a schematic view showing a transitional state (4) of the developing roller 510 during the manufacturing process of the developing roller 510.
Figure 19E:
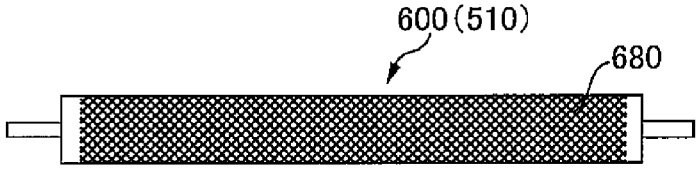
FIG. 19E is a schematic view showing a transitional state (5) of the developing roller 510 during the manufacturing process of the developing roller 510.
Figure 20:
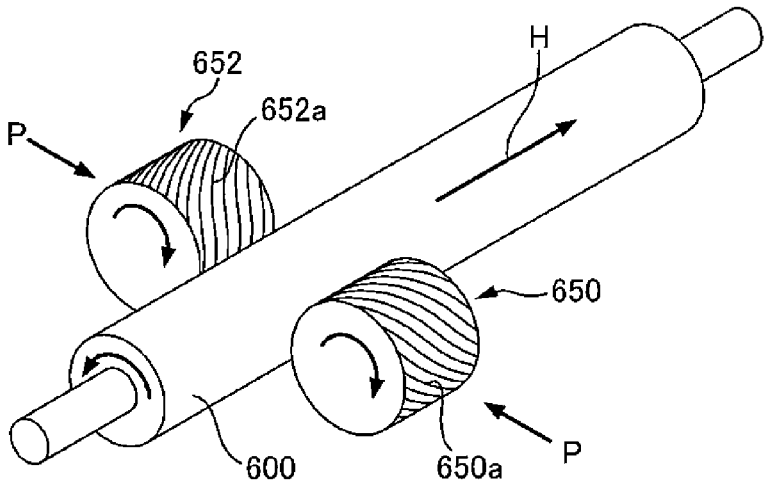
FIG. 20 is an explanatory diagram illustrating the rolling process of the developing roller 510.
Figure 21:
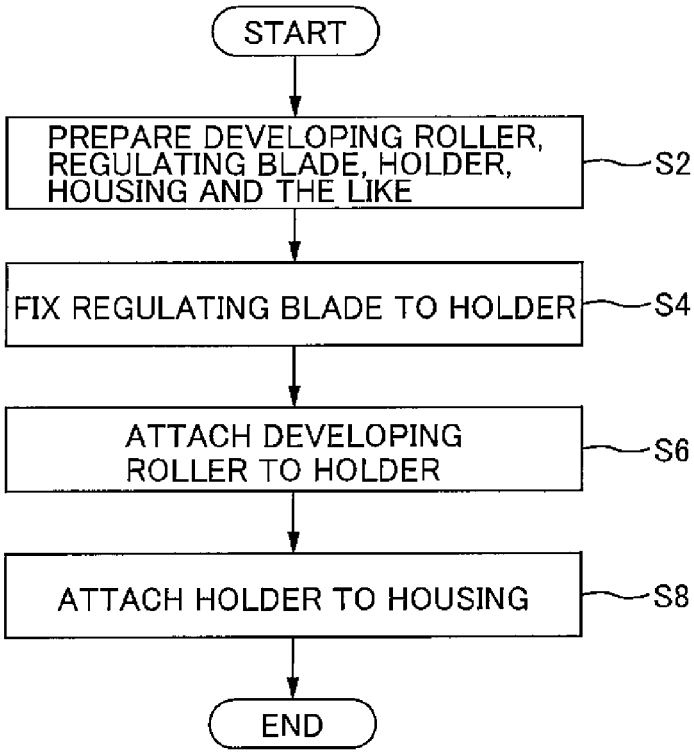
FIG. 21 is a flowchart for describing an assembly method for a yellow developing device 54.

The method for manufacturing the developing roller 510 is described here with reference to FIGS. 19A to 20.

First, as shown in FIG. 19A, a pipe member 600 is prepared, which is used as the base material of the developing roller 510. The wall thickness of this pipe member 600 is 0.5 to 3 mm. Next, as shown in FIG. 19B, flange press-fitting sections 602 are formed on both ends in the longitudinal direction of the pipe member 600. The flange press-fitting sections 602 are made by a cutting process. Next, as shown in FIG. 19C, flanges 604 are press-fitted to the flange press-fitting sections 602. In order to reliably fasten the flanges 604 to the pipe member 600, it is also possible to glue or weld the flanges 604 to the pipe member 600 after press-fitting the flanges 604. Next, as shown in FIG. 19D, the surface of the pipe member 600 to which the flanges 604 have been press-fitted is subjected to centerless grinding. This centerless grinding is performed on the entire surface, and the ten-point average roughness Rz of the surface after the centerless grinding is equal to or less than 1.0 μm. Next, as shown in FIG. 19E, the pipe member 600 to which the flanges 604 have been press-fitted is subjected to a rolling process. In this embodiment, a so-called through-feed rolling process (also referred to as "continuous rolling") using two round dies 650, 652 is performed.

That is to say, as shown in FIG. 20, two round dies 650, 652 arranged such that they sandwich the pipe member 600, which is the workpiece, are rotated in the same direction (see FIG. 20) while being pressed with a predetermined pressure (the direction of this pressure is marked with symbol P in FIG. 20) against the pipe member 600. In the through-feed rolling process, by rotating the round dies 650, 652, the pipe member 600 is moved in the direction marked by symbol H in FIG. 20 while rotating in the direction opposite to the rotation direction of the round dies 650, 652 (see FIG. 20). The surface of the round dies 650, 652 is provided with projection portions 650*a*, 652*a* for forming a groove 680, and the groove 680 is formed in the pipe member 600 by the projection portions 650*a*, 652*a* deforming the pipe member 600.

After completion of the rolling process, plating is performed on the surface of the central portion 510*a*. In the present embodiment, electroless Ni-P plating is employed for plating. However, there is no limitation to this, and hard chrome plating or electroplating may be employed, for example.

Method for Assembling the Yellow Developing Device 54

The method for assembling the yellow developing device 54 is described next with reference to FIG. 21.

First of all, the above-described housing 540, holder 526, developing roller 510, regulating blade 560 and the like are prepared (step S2). Next, the regulating blade 560 is fixed to the holder 526 as a result of being fixed to the regulating blade support section 526*c* with screws (step S4). The aforementioned end portion seal 574 is attached to the regulating blade 560 beforehand, before this step S4.

Then, the developing roller 510 is attached to the holder 526 to which the regulating blade 560 is fixed (step S6). At this timer the developing roller 510 is attached to the holder 526 such that the regulating blade 560 contacts against the developing roller 510 through one end portion to the other end portion in the axial direction of the developing roller 510. The aforementioned upper seal 520 is attached to the holder 526 beforehand, before this step S6.

Then, the holder 526 to which the developing roller 510, regulating blade 560 and the like are attached, is attached to the housing 540 via the housing seal 546 (step S8), thereby assembly of the yellow developing device 54 is completed. The aforementioned toner supply roller 550 is attached to the housing 540 beforehand, before this step S8.

Other Embodiments

An image forming apparatus according to the present invention was explained based on the foregoing embodiment, but the foregoing embodiment of the invention is merely for the purpose of elucidating the present invention and is not to be interpreted as limiting the present invention. The invention can of course be altered and improved without departing from the gist thereof and includes functional equivalents.

In the foregoing embodiment, an intermediate image transfer type full-color laser beam printer was described as an example of the image forming apparatus, however the present invention can also be applied to various other types of image forming apparatuses, such as full-color laser beam printers that are not of the intermediate image transfer type, monochrome laser beam printers, copying machines, and facsimiles.

Moreover, the photoconductor is not limited to a so-called photoconductive roller, which is configured by providing a photoconductive layer on the outer circumferential surface of a hollow cylindrical conductive base, and can also be a so-called photoconductive belt, which is configured by providing a photoconductive layer on the surface of a belt-shaped conductive base.

In the foregoing embodiment, as shown in FIG. 3A, the charging member is the charging roller 31 that is rotatable, and the charging roller 31 opposes the photoconductor 20 with a gap therebetween (in other words, the charging roller 31 charges the photoconductor 20 in a non-contacting state with the photoconductor 20). However, there is no limitation to this. For example, the charging roller 31 may charge the photoconductor 20 in a contacting state with the photoconductor 20.

It is known that density unevenness due to charging is likely to occur in the case of so-called non-contact charging, in which the charging roller 31 and photoconductor 20 are not contacting. Therefore, the foregoing embodiment is more preferable because it can more efficiently achieve the effect of the printer 10 of the present embodiment, in which the cycle T1 of the developing bias and the cycle T2 of the charging bias satisfy the condition of $T1 \neq nT2$, namely, the effect of suppressing conspicuous density unevenness in images.

Also in the foregoing embodiment, as shown in FIG. 19, the types of media on which images can be formed are plain paper and thick paper. The moving velocity V of the surface of the developing roller 510 is increased (300 mm/s) when forming images on the plain paper, and the moving velocity V of the surface of the developing roller 510 is decreased when forming images on the thick paper (150 mm/s). However, there is no limitation to this. For example, the moving velocity V of the surface of the developing roller 510 may be changed in accordance with installation environments of the printer 10.

When the moving velocity V of the developing roller 510 is changed depending on the type of a medium, the degree of the change tends to be greater since images are formed in accordance with the selected medium. For this reason, the above two expressions (that is, $T1 \leqq Lmin/V$, and $T1 \neq nT2$) can be certainly satisfied by changing the cycle T1 of the developing bias and the cycle T2 of the charging bias in accordance with the moving velocity V of the developing roller 510. As a result, even if the type of the medium is changed, it is possible to appropriately prevent occurrence of fog and suppress conspicuous density unevenness in images, and in this regard, the above embodiment is preferable.

In the foregoing embodiment, the concave section is two types of helical groove sections 512 with different inclination angles with respect to the circumferential direction of the developing roller 510, and the two types of helical groove sections 512 mutually intersect so as to form a grid pattern. However, there is no limitation to this.

For example, the concave section does not need to be groove-shaped. Also, when the concave sections are grooves, the grooves do not need to be helical. Further, only one type of groove section may be provided as the concave section.

In the foregoing embodiment, the developing roller 510 has the top surface 515 in a rhomboid shape surrounded by the two kinds of helical groove sections 512, and one of two diagonal lines of the rhomboid-shaped top surface 515 is along the circumferential direction. However, there is no limitation to this.

Figure 22A:
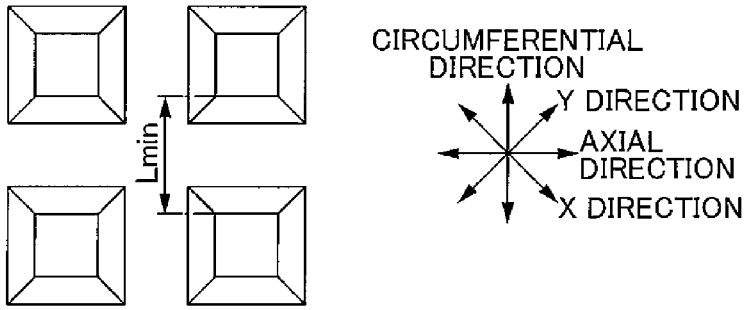
FIG. 22A shows a variation (1) of the surface shape of the developing roller 510.

For example, as shown in FIG. 22A, it is possible that neither of the two diagonal lines of the rhomboid-shaped top surface is along the circumferential direction.

In the foregoing embodiment, the developing roller 510 has the top surface 515 in a square shape surrounded by the two kinds of helical groove sections 512. However, there is no limitation to this.

Figure 22B:
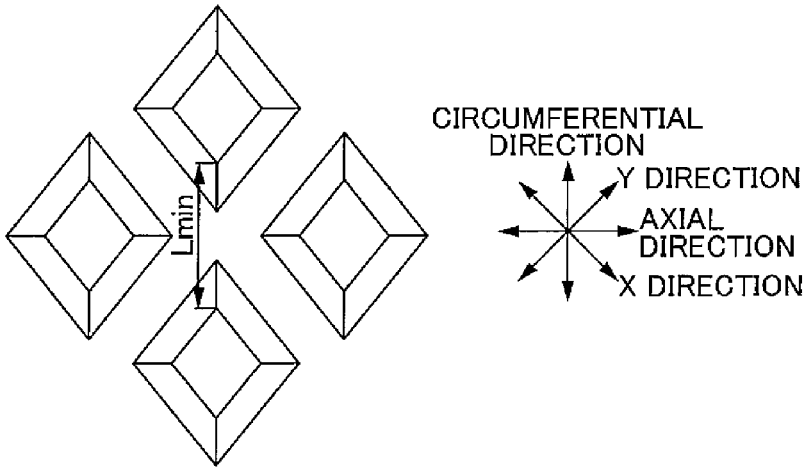
FIG. 22B shows a variation (2) of the surface shape of the developing roller 510.
Figure 22C:
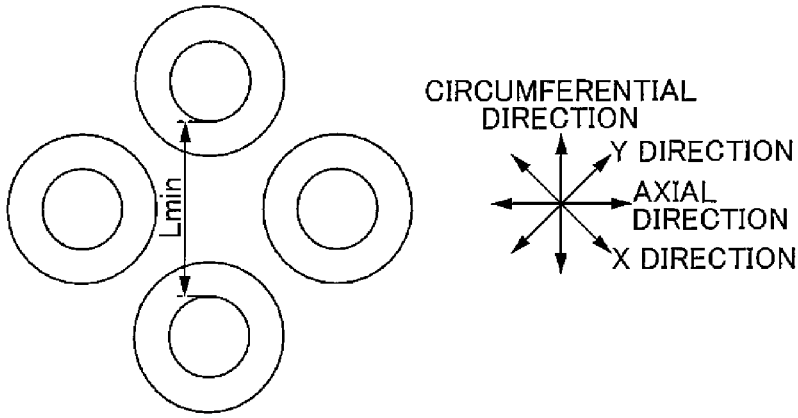
FIG. 22C shows a variation (3) of the surface shape of the developing roller 510.

For example, as shown in FIG. 22B, the top surface may have a rhomboid shape, which is not a square shape. Further, the top surface may have a round shape, for example, as shown in FIG. 22C, and not a rhomboid shape. Note that, FIGS. 22A to 22C show variations of the surface shape of the developing roller 510 (the above-described minimum width Lmin is indicated in each figure for reference).

In the foregoing embodiment, the groove section 512 includes the bottom surface 513 and the lateral surface 514, and the inclination angle of the lateral surface 514 is approximately 45 degrees (see FIG. 8). However, there is no limitation to this. For example, the inclination angle of the lateral surface 514 may be approximately 90 degrees.

In the foregoing embodiment, the voltage that the alternating voltage applying section 132 applies to the developing roller 510 is the first voltage V1 and the second voltage V2 only, and the alternating voltage applying section 132 applies the first voltage V1 and the second voltage V2 alternately. However, there is no limitation to this. For example, the alternating voltage applying section 132 may apply the alternating voltage such as that shown in FIG. 23A.

In the foregoing embodiment, the duty ratio of the alternating voltage is 50%. However, there is no limitation to this, and the alternating voltage such as the one shown in FIG. 23B may be applied.

Figure 23A:
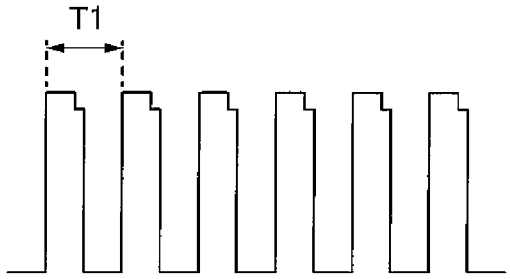
FIG. 23A shows a variation (1) of the developing bias.
Figure 23B:
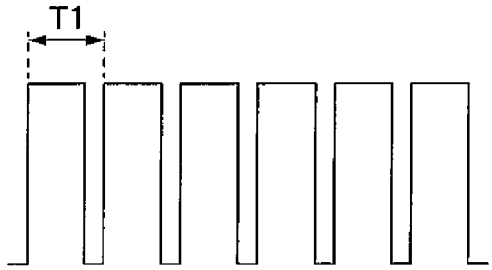
FIG. 23B shows a variation (2) of the developing bias.

FIGS. 23A and 23B are diagrams showing variations of the alternating voltages (the above-described cycle period T1 is indicated in each figure for reference).

In the foregoing embodiment, the moving velocity of the surface of the developing roller 510 during rotation of the developing roller 510 is different from the moving velocity of the surface of the photoconductor 20 during rotation of the photoconductor 20. However, there is no limitation to this. For example, the moving velocity of the both surfaces may be equal.

In the case where the moving velocity of the surface of the developing roller 510 during rotation of the developing roller 510 differs from the moving velocity of the surface of the photoconductor 20 during rotation of the photoconductor 20, compared with the case in which the both moving velocities of the surface are equal, when the fog-causing toner that is moved from the groove section 512 and made to adhere to the non-image area of the photoconductor 20 (a portion corresponding to white image) is drawn back to the developing roller 510 side due to the second voltage V2, it is likely that the toner is drawn back to the top surface 515 instead of the groove section 512. Therefore, the toner thus drawn back will have favorable chargeability, and in this respect, the foregoing embodiment is preferable.

Configuration of the Image Forming System, Etc.

Next, an embodiment of an image forming system serving as an example of an embodiment of the invention is described with reference to the drawings.

Figure 24:
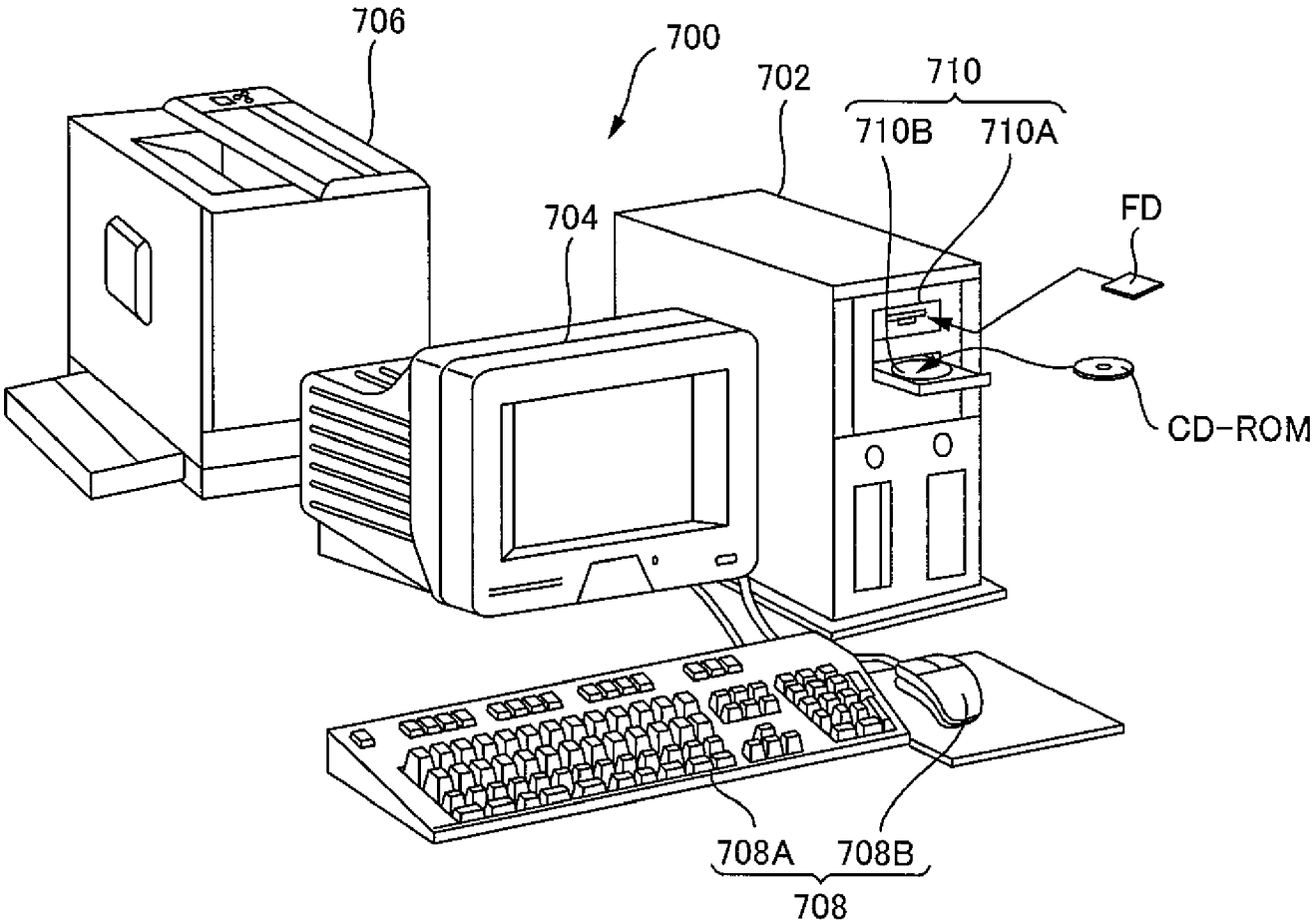
FIG. 24 is an explanatory diagram showing the external configuration of an image forming system.

FIG. 24 is an explanatory diagram showing the external configuration of the image forming system. An image forming system 700 is provided with a computer 702, a display device 704, a printer 706, input devices 708, and reading devices 710. In this embodiment, the computer 702 is contained within a mini-tower type housing, but there is no limitation to this. A CRT (cathode ray tube), a plasma display, a liquid crystal display device or the like is generally used as the display device 704, but there is no limitation to this. As the printer 706, the printer described above is used. In this embodiment, the input devices 708 are a keyboard 708A and a mouse 708B, but there is no limitation to these. In this embodiment, a flexible disk drive device 710A and a CD-ROM drive device 710B are used as the reading device 710, but the reading device 710 is not limited to these, and it may also be a MO (Magnet Optical) disk drive device or a DVD (Digital Versatile Disk) or the like, for example.

Figure 25:
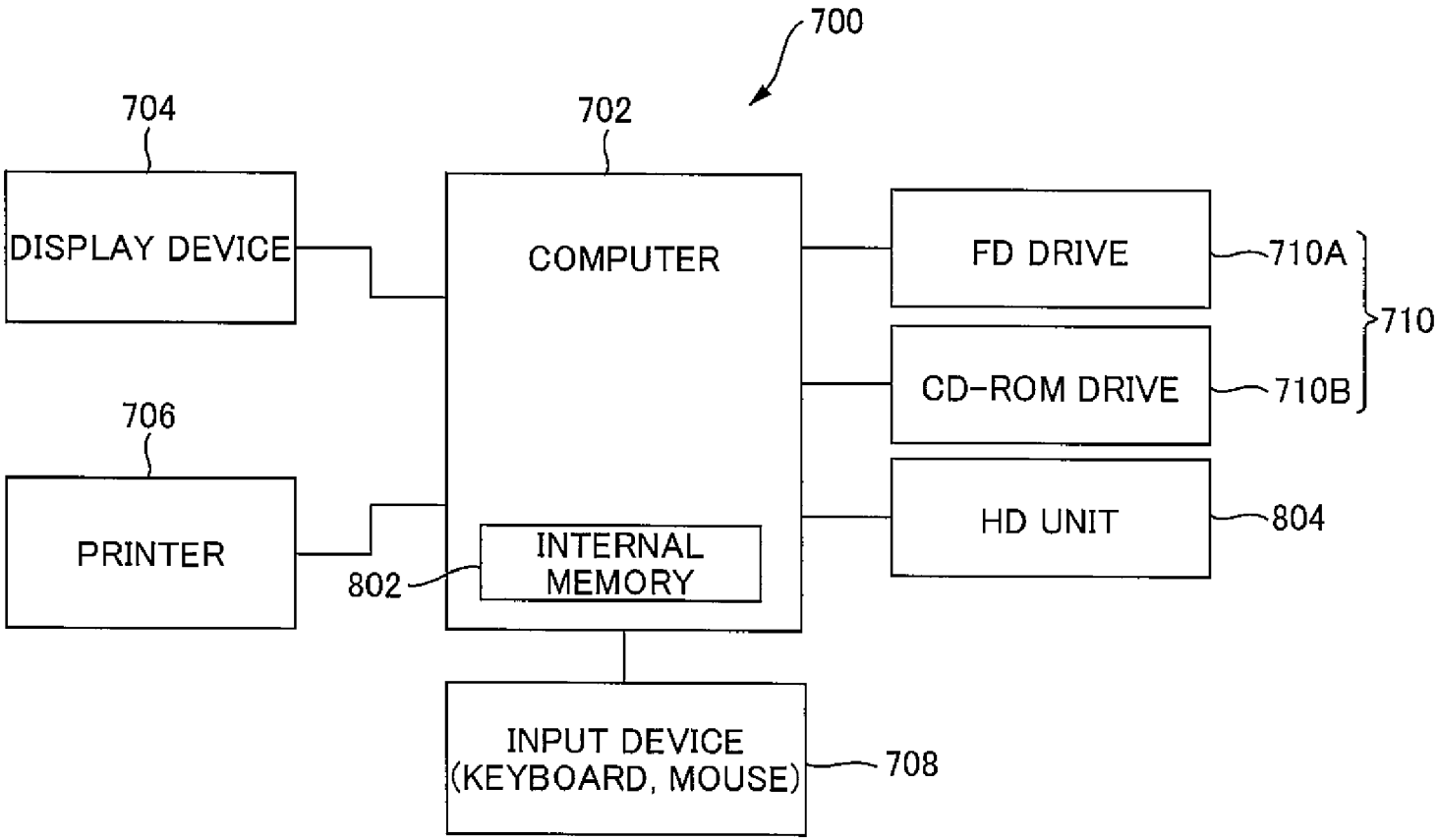
FIG. 25 is a block diagram showing the configuration of the image forming system shown in FIG. 24.

FIG. 25 is a block diagram showing the configuration of the image forming system shown in FIG. 24. An internal memory 802 such as a RAM is provided within the casing containing the computer 702, and an external memory such as a hard disk drive unit 804 is further provided.

Furthermore, in the above explanations, an example was given in which the image forming system is constituted by connecting the printer 706 to the computer 702, the display device 704, the input devices 708, and the reading devices 710, but there is no limitation to this. For example, the image forming system can also be made of the computer 702 and the printer 706, and the image forming system does not have to be provided with any one of the display device 704, the input devices 708, and the reading devices 710.

Furthermore, for example, the printer 706 may have some of the functions or mechanisms of each of the computer 702, the display device 704, the input devices 708, and the reading devices 710. For example, the printer 706 may be configured so as to have an image processing section for carrying out image processing, a display section for carrying out various types of displays, and a recording media mount/dismount section for mounting and dismounting recording media storing image data captured by a digital camera and the like.

As an overall system, the image forming system that is thus achieved becomes superior to conventional systems.

What is claimed is:

1. An image forming apparatus comprising:

an image bearing member for bearing a latent image;

a developer bearing member for transporting developer to an opposing position opposing the image bearing member by rotating with developer being borne thereon, the developer bearing member having regularly-disposed concave sections formed on a surface thereof; and an alternating voltage applying section for applying to the developer bearing member an alternating voltage that includes a first voltage for moving developer from the developer bearing member toward the image bearing member and a second voltage for moving developer from the image bearing member toward the developer bearing member in order to develop the latent image using the developer that has been transported to the opposing position, wherein a cycle period of the alternating voltage is smaller than or equal to a value obtained by dividing a minimum width of the concave section in a circumferential direction of the developer bearing member by a moving velocity of a surface of the developer bearing member during rotation of the developer bearing member, the moving velocity is variable, and when the moving velocity is changed, the cycle period of the alternating voltage is changed so that the cycle period of the alternating voltage is smaller than or equal to a value obtained by dividing the minimum width by the moving velocity.

2. An image forming apparatus according to claim 1, wherein the concave section is composed of two kinds of helical groove sections that have different inclination angles with respect to the circumferential direction, and the two kinds of helical groove sections mutually intersect so as to form a grid pattern.

3. An image forming apparatus according to claim 2, wherein the developer bearing member includes a rhomboid-shaped top surface surrounded by the two kinds of helical groove sections, and one of two diagonal lines of the rhomboid-shaped top surface is along the circumferential direction.

4. An image forming apparatus according to claim 2, wherein the developer bearing member includes a square-shaped top surface surrounded by the two kinds of helical groove sections.

5. An image forming apparatus according to claim 1, wherein the voltage that the alternating voltage applying section applies to the developer bearing member is only the first voltage and the second voltage, and the alternating voltage applying section alternately applies the first voltage and the second voltage.

6. An image forming apparatus according to claim 1, wherein the image bearing member is rotatable, and the moving velocity of the surface of the developer bearing member during rotation of the developer bearing member is different from a moving velocity of a surface of the image bearing member during rotation of the image bearing member.

7. An image forming apparatus according to claim 1, further comprising:

a charging member opposing the image bearing member, which is for charging the image bearing member; and a superimposed voltage applying section for applying to the charging member a superimposed voltage in which a DC voltage and an AC voltage are superimposed, wherein the cycle period of the alternating voltage is different from both of a value obtained by multiplying a cycle period of the superimposed voltage by any positive integer, and a value obtained by dividing the cycle period by any positive integer.

8. An image forming apparatus according to claim 7, wherein the charging member is a rotatable charging roller, and the charging roller opposes the image bearing member with a gap therebetween.

9. An image forming apparatus according to claim 7, wherein the image bearing member is rotatable, the alternating voltage applying section alternately applies the first voltage and the second voltage for a predetermined period, when a portion of the image bearing member that is positioned at a charging position for charging with the charging member when the superimposed voltage applying section starts applying the superimposed voltage, reaches a developing position for developing using the developer transported to the opposing position through rotation of the image bearing member, the alternating voltage applying section starts applying one of the first voltage and the second voltage to the developer bearing member.

10. An image forming apparatus according to claim 7, wherein the concave section is composed of two kinds of helical groove sections that have different inclination angles with respect to the circumferential direction, and the two kinds of helical groove sections mutually intersect so as to form a grid pattern, the developer bearing member includes a square-shaped top surface surrounded by the two kinds of helical groove sections, and one of two diagonal lines of the square-shaped top surface is along the circumferential direction.

11. An image forming method comprising:

changing a moving velocity of a surface of a developer bearing member during rotation thereof, the developer bearing member being for transporting developer to an opposing position opposing an image bearing member by rotating with developer being borne thereon, and including regularly-disposed concave sections formed on the surface thereof, changing a cycle period of an alternating voltage that includes a first voltage for moving developer from the developer bearing member toward the image bearing member and a second voltage for moving developer from the image bearing member toward the developer bearing member so that the cycle period of the alternating voltage is smaller than or equal to a value obtained by dividing a minimum width of the concave section in a circumferential direction of the developer bearing member by the moving velocity after change, and changing a cycle period of a superimposed voltage in which a DC voltage and an AC voltage are superimposed, such that the cycle period after change of the alternating voltage are different from both of a value obtained by multiplying the changed cycle period of the superimposed voltage by any positive integer, and a value obtained by dividing the changed cycle period by any positive integer, charging the image bearing member by applying the superimposed voltage, whose cycle period has been changed, to a charging member opposing the image bearing member, and developing a latent image borne on the image bearing member using the developer that has been transported to the opposing position by applying the alternating voltage, whose cycle period has been changed, to the developer bearing member.

12. An image forming method according to claim 11, wherein types of media on which an image can be formed are plain paper and thick paper, and when an image is formed on the plain paper, the moving velocity of the surface of the developer bearing member is increased, and when an image is formed on the thick paper, the moving velocity of the surface of the developer bearing member is decreased.

13. An image forming system comprising:

a computer; and an image forming apparatus that can be connected to the computer, including an image bearing member for bearing a latent image, a developer bearing member for transporting developer to an opposing position opposing the image bearing member by rotating with developer being borne thereon, the developer bearing member having regularly-disposed concave sections formed on a surface thereof, and an alternating voltage applying section for applying to the developer bearing member an alternating voltage that includes a first voltage for moving developer from the developer bearing member toward the image bearing member and a second voltage for moving developer from the image bearing member toward the developer bearing member in order to develop the latent image using the developer that has been transported to the opposing position, wherein a cycle period of the alternating voltage is smaller than or equal to a value obtained by dividing a minimum width of the concave section in a circumferential direction of the developer bearing member by a moving velocity of a surface of the developer bearing member during rotation of the developer bearing member, the moving velocity is variable, and when the moving velocity is changed, the cycle period of the alternating voltage is changed so that the cycle period of the alternating voltage is smaller than or equal to a value obtained by dividing the minimum width by the moving velocity.

* * * * *